US005875574A

United States Patent [19]

De Rugeriis

[11] Patent Number: 5,875,574

[45] Date of Patent: Mar. 2, 1999

[54] FOLDING IRONING BOARD FOR CLOTHES

[76] Inventor: Avana De Rugeriis, 9 rue de l'Orne—57390, Audun Le Tiche, France

[21] Appl. No.: 894,071

[22] PCT Filed: Jan. 29, 1996

[86] PCT No.: PCT/FR96/00146

§ 371 Date: Jul. 24, 1997

§ 102(e) Date: Jul. 24, 1997

[87] PCT Pub. No.: WO96/23926

PCT Pub. Date: Aug. 8, 1996

[30] Foreign Application Priority Data

Jan. 30, 1995 [FR] France ..... 95/01152

[51] Int. Cl.[6] ..... D06F 81/02

[52] U.S. Cl. ..... 38/137

[58] Field of Search ..... 38/137, 138, 139, 38/DIG. 1, DIG. 2, DIG. 3; 108/115, 117, 119, 127, 131

[56] References Cited

U.S. PATENT DOCUMENTS

| | | | |
|---|---|---|---|
| 2,554,446 | 5/1951 | Nestor | 38/139 |
| 2,637,919 | 5/1953 | Buchanan | 38/138 |
| 2,718,077 | 9/1955 | Grissette | 38/138 |
| 2,864,187 | 12/1958 | Radliff | 38/115 |
| 4,903,421 | 2/1990 | Saito | 38/137 |

FOREIGN PATENT DOCUMENTS

| | | | |
|---|---|---|---|
| 91 06 178 | 7/1991 | Germany . | |
| 761146 | 11/1956 | United Kingdom | 38/139 |
| 1557206 | 12/1979 | United Kingdom . | |

*Primary Examiner*—Ismael Izaguirre
*Attorney, Agent, or Firm*—Parkhurst & Wendel, L.L.P.

[57] ABSTRACT

An ironing board for thoroughly ironing all parts of trousers, skirts and two-legged garments whether plain or pleated at the waist and having pockets, as well as blouses, dresses and jackets, including the whole of each sleeve. The ironing board is a long, thin board onto which the garment is passed and below which are two U-shaped supporting legs hingedly interconnected by their upper horizontal arms so that they can be folded out flat on either side of the board, and also can connect the lower horizontal arms of the two legs together so that they are further apart than the spacing between the two upper arms to ensure that the two legs remain stable in the erected position. The ironing board can be placed on an ordinary table or on a standard ironing board.

17 Claims, 30 Drawing Sheets

80
85
86

84
84′
85
83

80
81
85
84′
83
80
81

84
86
85
83

87
87′
86

85
85
87
82
81

ICA
ICB
80

82
81
95
96
97

80
95
97
96
96
95
97

95
97
96
81
80

87
87'
96
97

98
99

FOLDING IRONING BOARD FOR CLOTHES

BACKGROUND

The invention relates to a board for ironing garments, namely pants, skirts, blouses, jackets, dresses, including the sleeves, that is, the whole garment in its entirety, to allow garments to be ironed perfectly in the least accessible areas. The inventive board has therefore been created for the purpose of ironing garments and could be associated with an ironing table, or larger ironing board, so that the two become one, and this would allow it to be used in all manner of ways depending on the difficulties encountered when ironing such clothing or garments.

Traditionally, there was the large ironing board which is composed of a fairly broad (about 30 to 45 centimeters) board approximately 120 centimeters long placed and fixed on long folding legs which, when placed on the high ground, stand approximately 90 to 110 centimeters high (depending on the height to which the ironing board is adjusted), and forming a large X. Said ironing board does not allow the garments to be ironed in the least accessible areas without creasing, that is to say does not allow pants, for example, to be slipped fully over the board as the legs and width of said board prevent this.

Likewise, there was the smaller sleeve board which allowed just a small bit of the sleeves of the garments to be ironed, whereas the inventive board allows the ironing of garments, and also, as compared with the sleeve board, allows the entire length of the sleeves to be ironed by the sleeves being slipped fully over the board, because it is longer than the former sleeve board.

BRIEF SUMMARY OF THE INVENTION

The ironing board according to the invention is therefore intended for ironing garments in their entirety, and in the least accessible areas, and comprises a long narrow board under which is fixed a metal support/base that folds out sideways. Under the board there are two support legs in the shape of a horizontal U, articulated at their horizontal upper arms so that they can be folded out flat on either side of the board, and means for connecting the lower horizontal arms of the two legs together so that they are further apart than the spacing between the two upper arms, to ensure that the two legs remain stable in the erected position. The legs may be of unequal height and length to allow the ironing board to be placed in a horizontally offset position with respect to the surface of a larger board to which it is attached, the lower arms of the support legs being slipped into holding means beneath the larger ironing board. Articulations between the upper arms and a larger board may consist of grooves in the arms held in saddle clips fixed under the larger board and thus holding the arms axially in place. The lower arms of the legs are longer than the upper arms. The board has connecting means namely pivoting means fixed under the larger ironing board in such a way that the board can be folded under the larger ironing board. The board is mounted so that it can pivot about a vertical axis on the horizontal upper arms so as to be able to free up the working area of the larger ironing board.

BRIEF DESCRIPTION OF THE DRAWINGS

Further features and advantages of the present invention will be made clear with reference to the following drawings of various embodiments of the invention, as follows.

DETAILED DESCRIPTION OF THE INVENTION

Figure 1A:
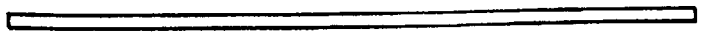
FIGS. 1A, 1B and 1C are edge, top and bottom views, respectively, of a first embodiment of the ironing board of the present invention.
Figure 1B:
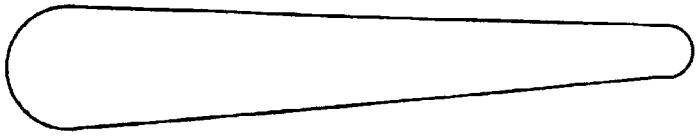
Figure 57:
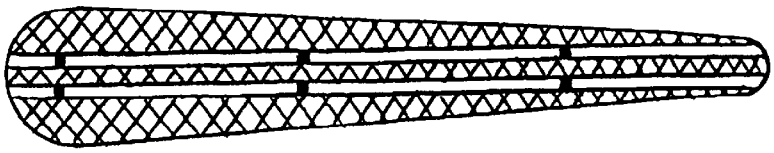
FIG. 57 is a bottom view of a mesh ironing board according to the present invention showing the location of support/base structure and fixtures therefor.

The ironing board of the present invention comprises a flat board portion as illustrated, for example, in FIGS. 1A and 1B, wherein the board has a length of approximately 120 centimeters, and a thickness as illustrated in FIG. 1A of 1.5 to 2 centimeters. As shown in FIG. 1B, the width of the board tapers from a width of about 22 centimeters at the widest point at the left end, to a width of about 9 centimeters near the right end. These board dimensions should accommodate most pants which may average in length about 110 to about 115 centimeters, while also accommodating not only smaller youth sizes, but also much longer sizes for tall individuals. The ironing board portion of the structure may be made from solid material such as chipboard, i.e., wood/glue composite material. Other embodiments of the board may be formed from a metal mesh surface supported by metal supporting structure, as discussed below in connection with FIGS. 57–59.

Figure 1C:
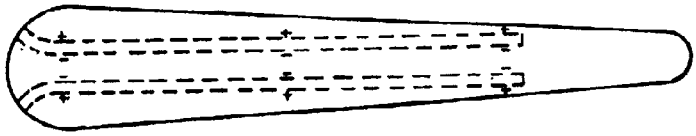

FIG. 1C is a bottom view of the board shown in FIG. 1B, and in FIG. 1C the location of the support/base structure and the locations ± of the connecting means which connect the support/base to the bottom of the board are also shown.

Figure 2:
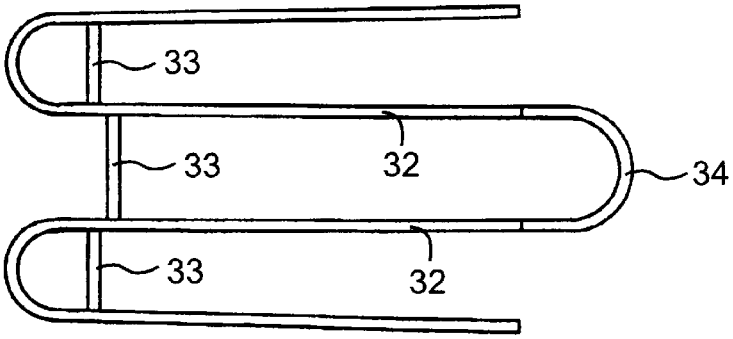
FIG. 2 illustrates the assembled support/base for the ironing board of the present invention.
Figure 3:
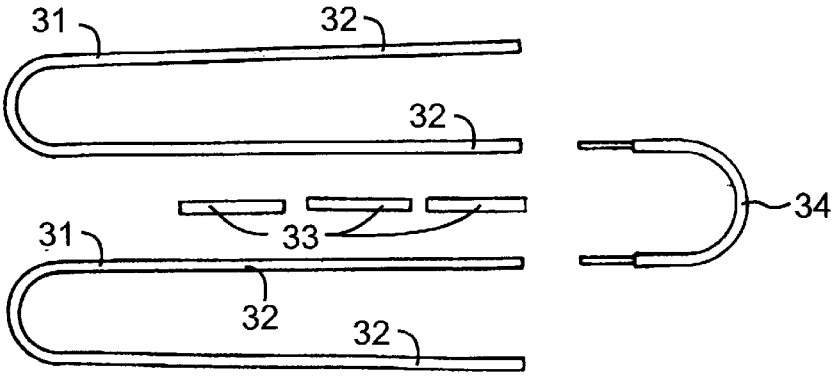
FIG. 3 is a partially-exploded, dis-assembled view of the support/base of FIG. 2.

A first embodiment of the support/base structure of the present invention is shown, fully assembled, in FIG. 2. FIG. 3 illustrates the parts of the support/base structure of FIG. 2, but in FIG. 3, those parts are illustrated in partially-exploded form ready for assembly. Those parts comprise two U-shaped or horseshoe-shaped lengths of tubing, which may be made of steel or copper metallic tubing about 2.40 centimeters in diameter. Each leg of each U-shaped structure has a length of approximately 90 centimeters and each of the structures is about 18 to 20 centimeters in width near the U-shaped base portion of the member. Near the free ends of the legs 32 the legs are approximately 18 to 21.5 centimeters apart. Spacer bars 33 are about 17 to 20 centimeters in length and are assembled between the ends of the legs 32 near the U-shaped bends, as shown in FIG. 2, and a third spacer 33 is assembled between the adjacent legs of the two U-shaped elements.

Finally, another U-shaped or horseshoe-shaped element 34 shown at the right side of FIGS. 2 and 3 connects the adjacent legs of the longer U-shaped elements. As shown in FIG. 3, for example, the ends of the legs of U-shaped element 34 may fit inside the adjacent tubular legs 32 of the longer U-shaped elements 31. The main portions of the short horseshoe 34 form a U-shape about 20 centimeters in depth from its open end toward its closed curved end, and each of the legs of that U-shaped structure may also include about 10 centimeters in length of smaller diameter tubing capable of fitting inside the ends of legs 32 of the adjacent longer U-shaped elements of the support/base structure of the present invention.

Assembly of the ironing board with support/base of the present invention can be seen with respect to FIGS. 2, 3 and 4–6. First taking the long, U-shaped leg pieces 31, 32 as illustrated in FIG. 3, a short straight connecting bar 33 is then connected between adjacent legs 32 adjacent U-shaped base portions 31 as illustrated in FIG. 2. This bar 33 can be connected to each of the legs 32 with screws or other fasteners and should be located about 20 centimeters from the line tangent to the bottom of each of the U-shaped portions. Thereafter, two additional short connecting bars 33 are connected between the legs 32 of each U-shaped base portion 31, as also shown in FIG. 2 and again in FIG. 4.

Figure 4:
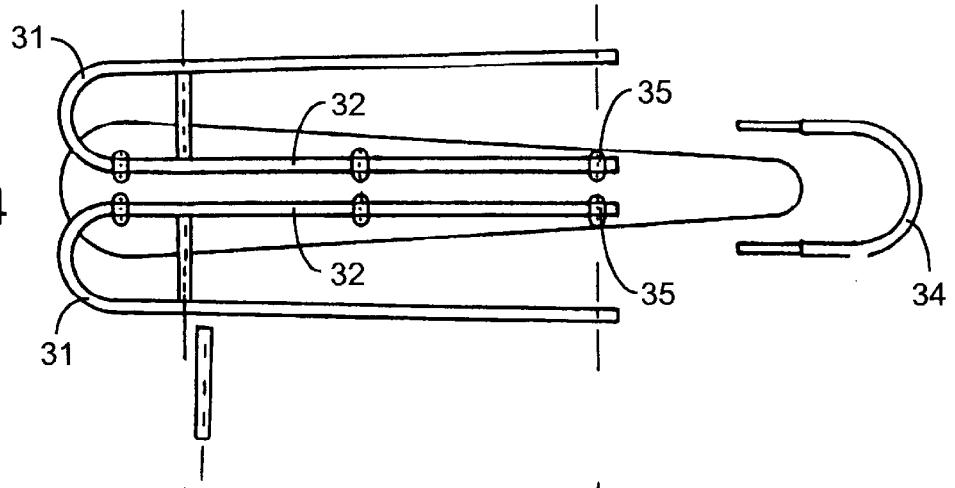
FIG. 4 is a bottom view showing the support/base in partially-exploded condition.
Figure 5:
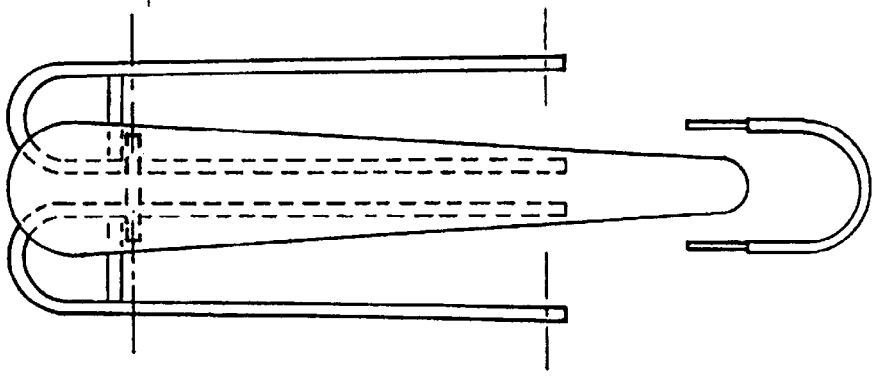
FIG. 5 is a top view similar to FIG. 4.
Figure 6:
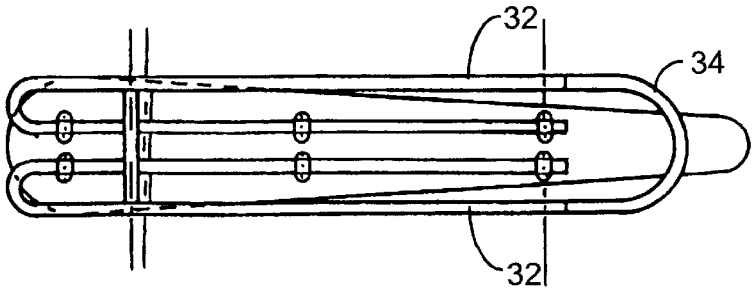
FIG. 6 is a bottom view showing the support/base in fully assembled condition.

With the basic support/base structure thus assembled, the two lower legs of the pair of now-connected base portions 31 are placed on the underside of the board in the position shown in FIG. 4, keeping those adjacent legs parallel and about 10 centimeters apart with the end fittings 33 about 28 centimeters from the right end of the under side of the board. The fittings or fasteners used to connect legs 32 to the bottom of the board may be saddle-like clips which span over the circumference of legs 32 and are attached, by screws or the like, at each end to the bottom of the board. Once the pair of U-shaped base portions are thus connected to the bottom of the board, the right ends of the free legs 32 are then connected by insertion of the smaller diameter ends of smaller U-shaped horseshoe 34 therein as illustrated in FIG. 2 and again in FIG. 6. FIG. 5 is a top view of the same elements shown in FIG. 4, and FIG. 6 is a bottom view like FIG. 4 but wherein the short horseshoe 34 has been inserted in the free ends of legs 32 thus completing assembly of the support/base structure with the board.

Figure 10:
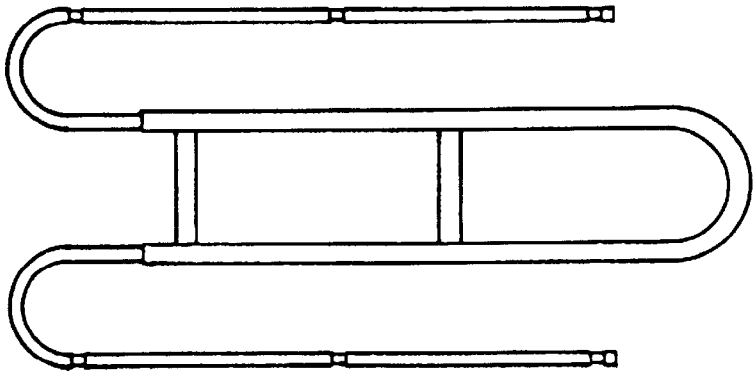
FIG. 10 illustrates an assembled second embodiment of the support/base for an ironing board of the present invention.
Figure 11:
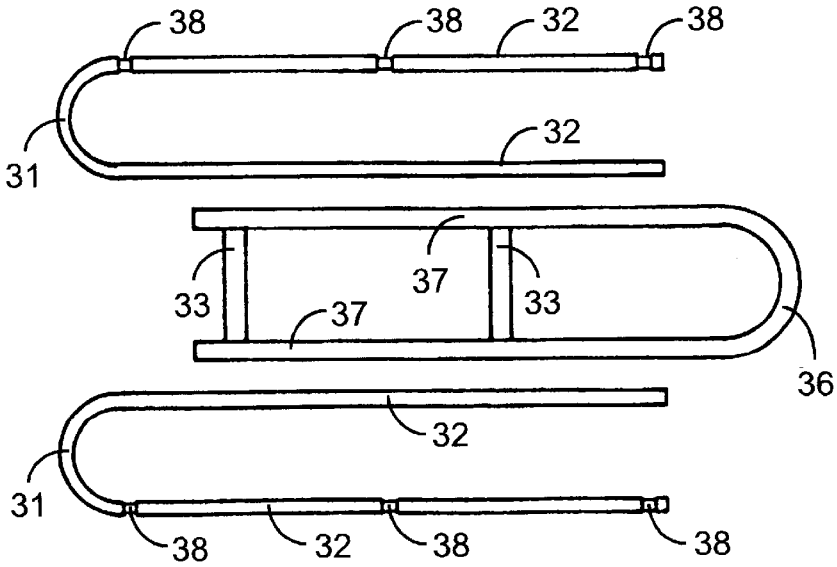
FIG. 11 is a dis-assembled view of the embodiment of FIG. 10.

A second embodiment of the advantageous support/base structure of the present invention is shown in FIGS. 10 and 11, and shown being assembled with the board in FIGS. 12–17. In this version, as illustrated in FIG. 11, the support/base comprises two long U-shaped base elements 31 each having legs 32. Base portions 31 are formed of steel or copper metallic tubing about 2.40 centimeters in diameter with each leg being about 90 centimeters long and the legs of each base portion being spaced apart 18 to 20 centimeters at their left, U-shaped ends and about 18 to 21.50 centimeters at their open, right ends.

Figure 12:
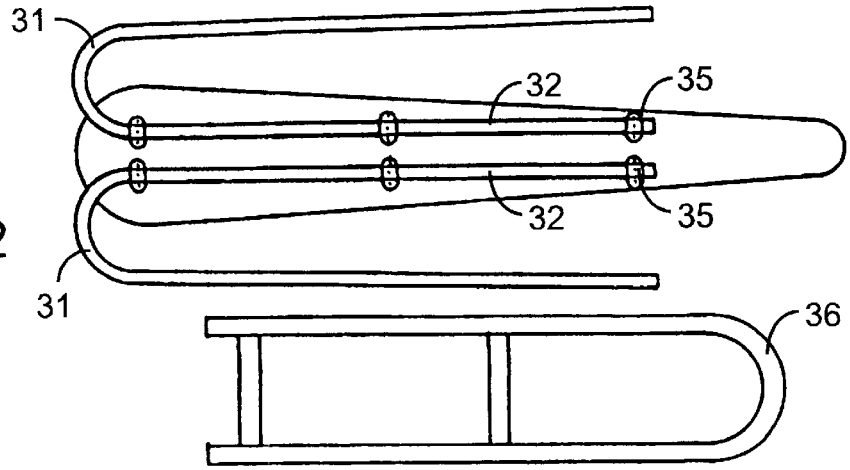
FIG. 12 is a bottom view of an ironing board of the present invention fitted with the support/base of FIGS. 10 and 11, shown in partially assembled form.

This embodiment of the support/base structure also includes a third U-shaped element 36 formed of steel or copper metallic tubing having a larger inside diameter than the outside diameter of legs 32 of base portions 31. The long leg portions 37 of element 36 are about 90 centimeters in length and are spaced apart about 17 to 20 centimeters. Legs 37 are also connected by short connecting bars 33. One of the legs 32 of each of the base portions 31 also includes annular grooves 38. When these grooved legs are placed on the back side of an ironing board as illustrated in FIG. 12, in parallel relationship about 10 centimeters apart, with their right ends about 28 centimeters from the right end of the board, saddle clips or other suitable fasteners can be placed over the annular groove recessed portion thereof and screwed into the bottom of the board thus affixing legs 32 of base portions 31 to the bottom of the board, as illustrated in FIG. 12. The top view of the partially assembled board as shown in FIG. 12 is illustrated in FIG. 13.

Figure 13:
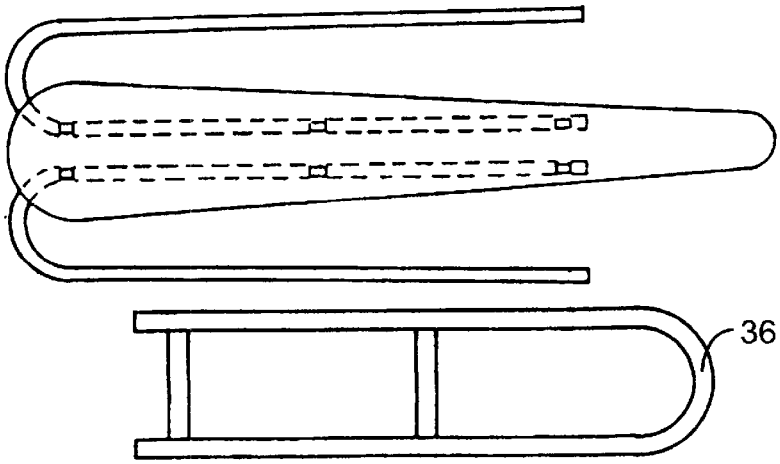
FIG. 13 is a top view of the ironing board of FIG. 12, fitted with the support/base of FIGS. 10 and 11, shown in partially assembled form.
Figure 14:
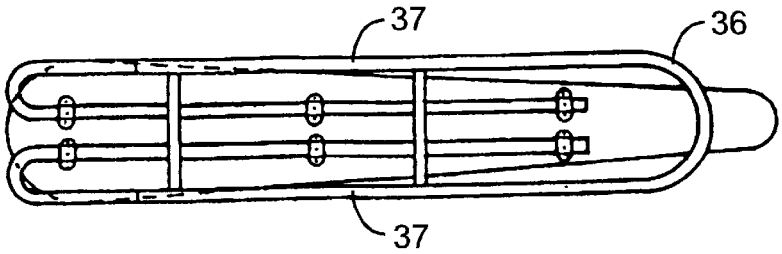
FIG. 14 is a bottom view of an ironing board of the present invention fitted with the support/base of FIGS. 10 and 11, shown in fully assembled form.

FIG. 14 shows the board of FIGS. 12 and 13 now having the third tubular, U-shaped element slipped over the free ends of legs 32 opposite the legs attached to the back of the board, so that the length of legs 37 of tubular element 36 extends over substantially the length of leg 32 of each of the base portions 31, thus providing the assembled support/base structure stability.

Figure 15:
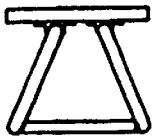
FIG. 15 is an end view of the inventive board with assembled support/base from the left end as shown in FIGS. 14, 16 and 17.
Figure 16:
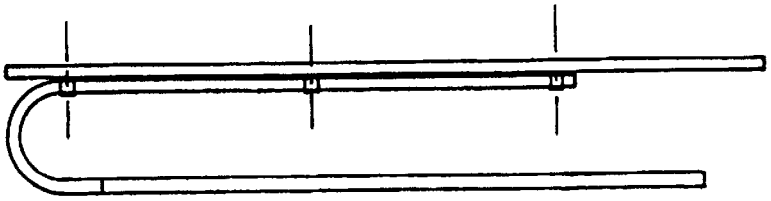
FIG. 16 is a side view of the embodiment of a fully assembled board and support/base of the present invention of FIGS. 14, 15 and 17.
Figure 17:
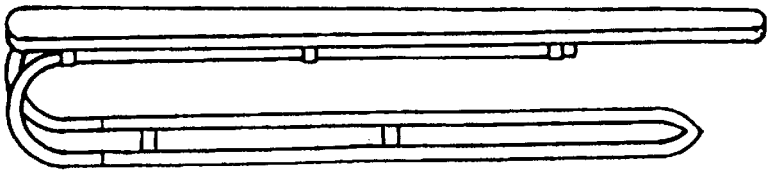
FIG. 17 is a top/side view of the embodiment of FIG. 16.

FIG. 15 shows an end view of the assembled board with support/base as shown in FIG. 14, but standing upright on its support base, and viewed from the left end as oriented in FIG. 14. FIGS. 16 and 17 show a side view and a top/side view, respectively, of the assembled board with support/base as illustrated in FIGS. 14 and 15, standing upright on its base as in FIG. 15.

Figure 7:
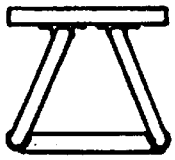
FIG. 7 is an end view of the inventive board with assembled support/base from the left end as shown in FIG. 9.
Figure 8:
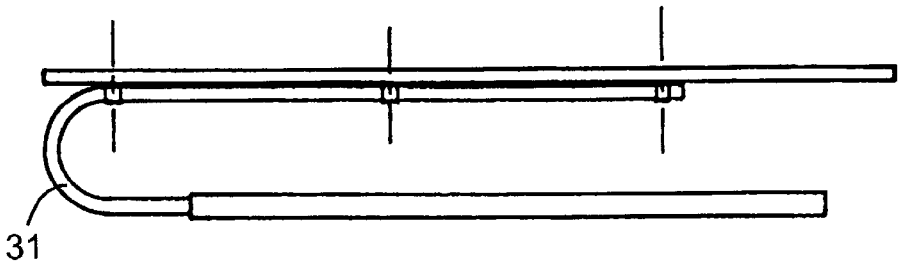
FIG. 8 is a side view of a further embodiment of a fully assembled board and support/base of the present invention.
Figure 9:
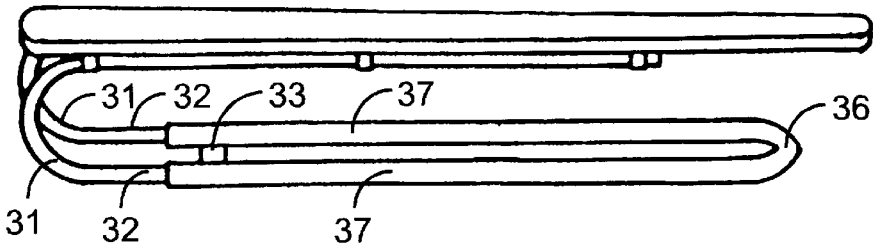
FIG. 9 is a top/side view of the embodiment of FIG. 8.

Another embodiment of the support/base structure of the present invention is illustrated in FIGS. 7–9 wherein the U-shaped base portions are formed like those illustrated in FIG. 3, without any cross braces 33 as shown in FIG. 2, and a third U-shaped tubular member is shown slipped over the free ends of legs 32 providing stability to the assembled support/base structure as in the embodiment illustrated in FIGS. 10–17. In the embodiment illustrated in FIG. 9, the tubular U-shaped member 36 has a single cross brace 33 near the free ends of legs 37 of tubular member 36.

Figure 18:
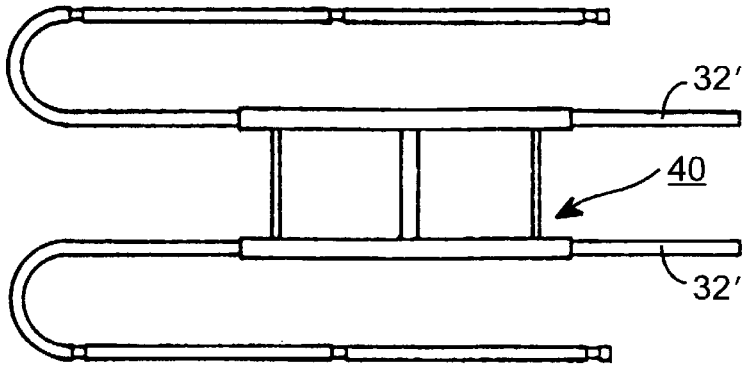
FIG. 18 is a view of an assembled third embodiment of the support/base for an ironing board of the present invention.
Figure 19:
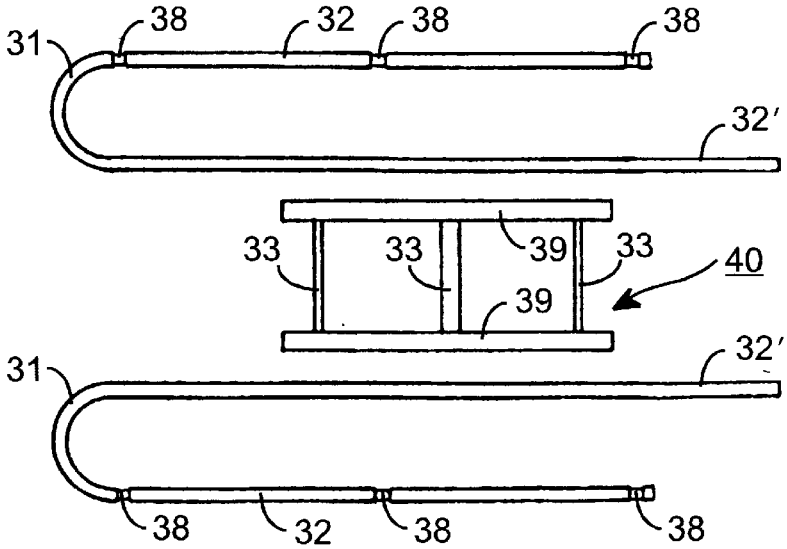
FIG. 19 is a dis-assembled view of the embodiment of FIG. 18.

A third embodiment of the support/base structure is illustrated in FIGS. 18 and 19, and shown assembled with a board of the present invention in FIGS. 20–25. This embodiment includes long, U-shaped base portions 31 one leg 32 of which includes circumferential grooves 38, shown in FIG. 19, like the structure shown and described in conjunction with FIG. 11. Additionally, the opposite leg 32' of each U-shaped base portion is somewhat longer than the other leg portion 32. In this embodiment, the third element of the base portion comprises a pair of tubular bars 39 having inside diameter greater than the outside diameter of long legs 32', and tubular bars 39 are arranged parallel to each other and connected by a plurality of connecting bars 33 forming a ladder-like rectilinear structure 40. When this structure 40 is assembled over the free ends of longer legs 32', the free ends of those longer legs 32' may extend through tubular legs 39 of rectilinear portion 40, as illustrated in FIG. 18.

Figure 20:
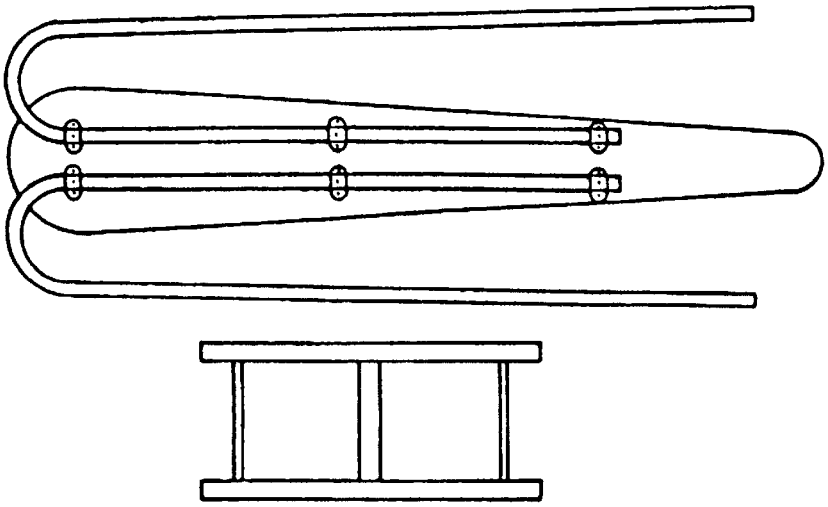
FIG. 20 is a bottom view of an ironing board of the present invention fitted with the support/base of FIGS. 18 and 19, shown in partially assembled form.
Figure 21:
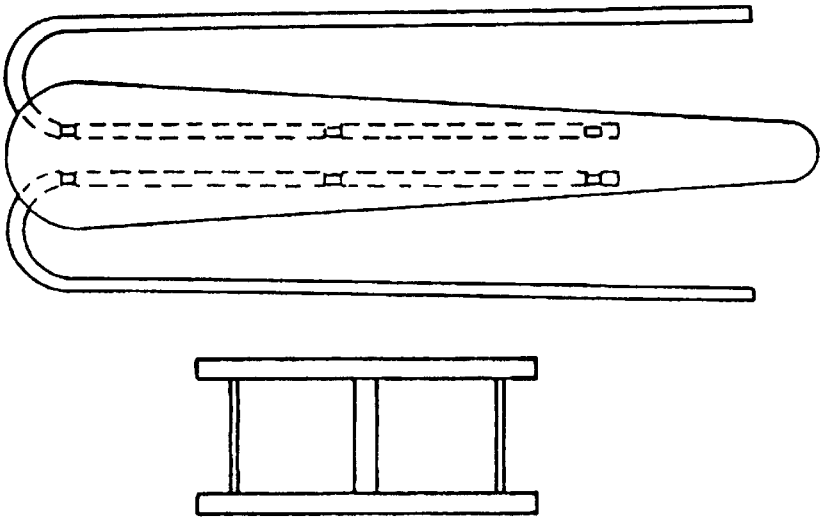
FIG. 21 is a top view of an ironing board of FIG. 20 fitted with the support/base of FIGS. 18 and 19, shown in partially assembled form.
Figure 22:
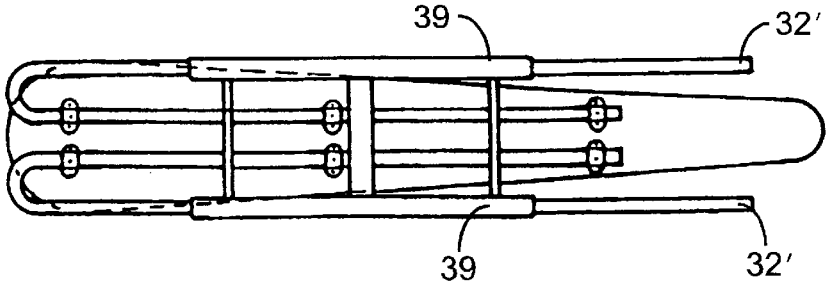
FIG. 22 is a bottom view of an ironing board of the present invention fitted with the support/base of FIGS. 18 and 19, shown in fully assembled form.
Figure 23:
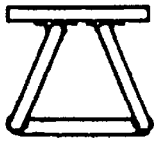
FIG. 23 is an end view of the inventive board with assembled support/base from the left end as shown in FIGS. 22, 24 and 25.
Figure 24:
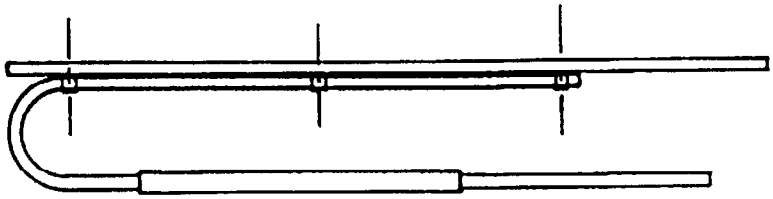
FIG. 24 is a side view of the fully assembled board and support/base of the present invention as shown in FIGS. 22, 23 and 25.
Figure 25:
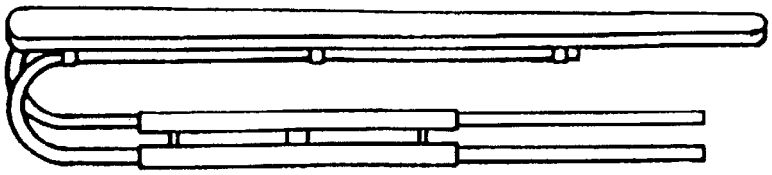
FIG. 25 is a top/side view of the embodiment of FIG. 24.

As illustrated in FIGS. 20 and 21, legs 32 having annular grooves or recesses 38 therein are connected to the back surface of a board in the same way in which the legs illustrated in FIGS. 11–13 were connected. This is shown in FIGS. 20 and 21. Then, assembly of the support/base structure is completed by slipping the tubular legs 39 of rectilinear frame 40 over the free end of legs 32', as illustrated in FIG. 22. This assembled structure is also shown in FIGS. 23, 24 and 25 in views which correspond to the views of FIGS. 15, 16 and 17, respectively.

In this embodiment, the dimensions of the base portions 31 are similar to the dimensions of those portions as described in the earlier embodiments. Rectilinear structure 40 comprises two tubular side rails 39 of diameter larger than the outside diameter of legs 32' and having a length of about 50 centimeters. The width of structure 40 is about 20 to 24.8 centimeters, the tubular legs 39 being connected by two or more connecting bars 33.

Figure 26:
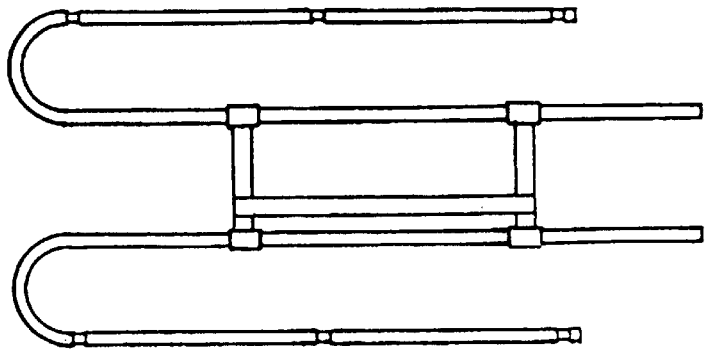
FIG. 26 is a view of an assembled fourth embodiment of the support/base for an ironing board of the present invention.
Figure 27:
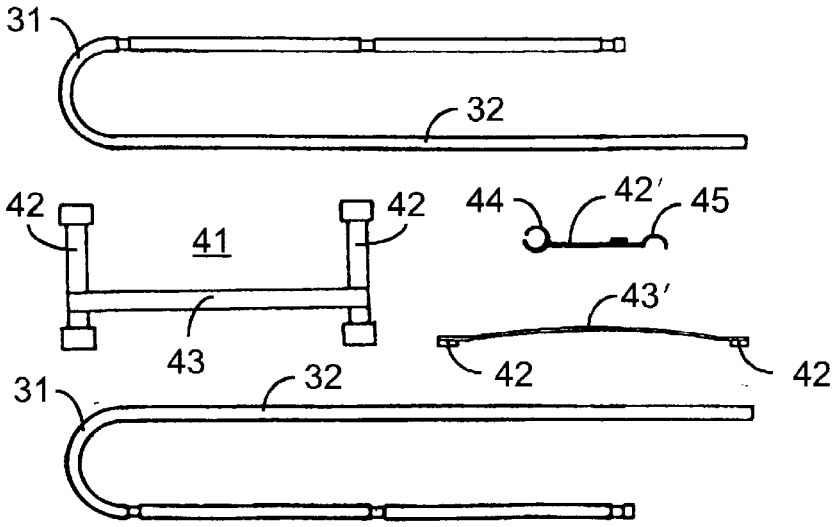
FIG. 27 is a dis-assembled view of the embodiment of FIG. 26.

A fourth embodiment of the support/base for an ironing board of the present invention is illustrated in FIG. 26, and the same embodiment is illustrated in a dis-assembled view in FIG. 27. This embodiment includes base portions 31 like those illustrated and discussed with respect to the embodiment of FIGS. 18–25, but includes a rectilinear frame 41 which is structurally different from rectilinear frame 40 in the embodiment of FIGS. 18–25. As illustrated in FIG. 27, frame 41 comprises two end cross members 42, one of which is shown in end or edge view 42'. Cross members 42 are connected by a longitudinal handle 43 joining cross pieces 42 as shown in edge view at 43'. End or cross members 42 include a substantial circumferential hook 44 at one end and a semi-circumferential hook 45 at the other end.

Figure 28:
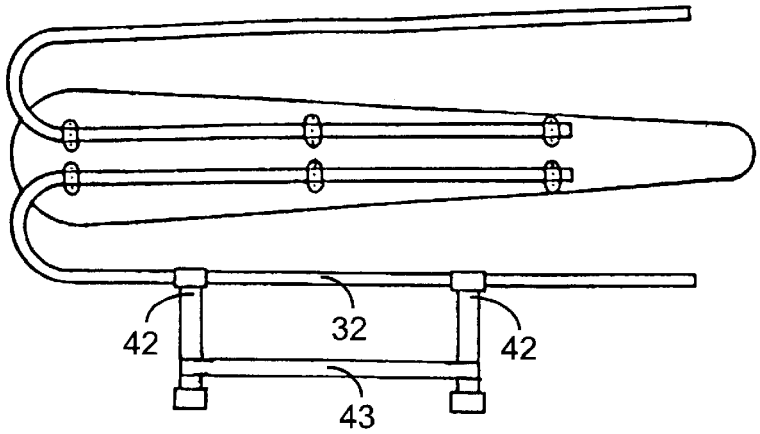
FIG. 28 is a bottom view of an ironing board of the present invention fitted with the support/base of FIGS. 26 and 27, shown in partially assembled form.
Figure 29:
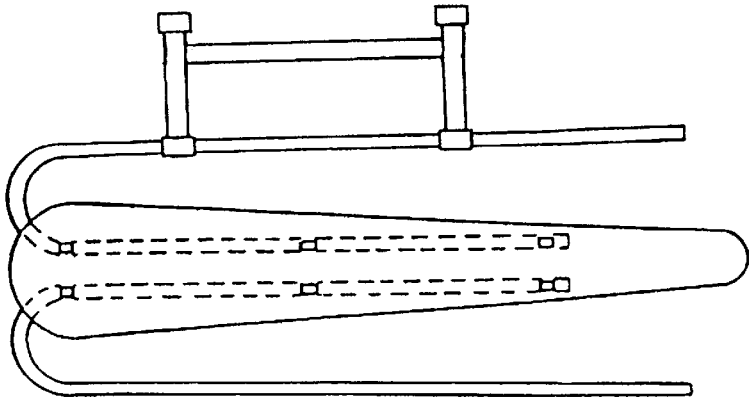
FIG. 29 is a top view of an ironing board of FIG. 28 fitted with the support/base of FIGS. 26 and 27, shown in partially assembled form.
Figure 30:
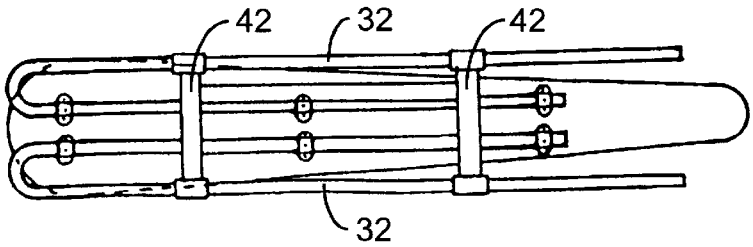
FIG. 30 is a bottom view of an ironing board of FIGS. 28 and 29 fitted with the support/base of FIGS. 26 and 27, shown in fully assembled form.
Figure 31:
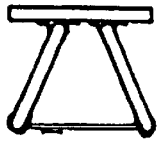
FIG. 31 is an end view of the inventive board with assembled support/base from the left end as shown in FIGS. 30, 32 and 33.
Figure 32:
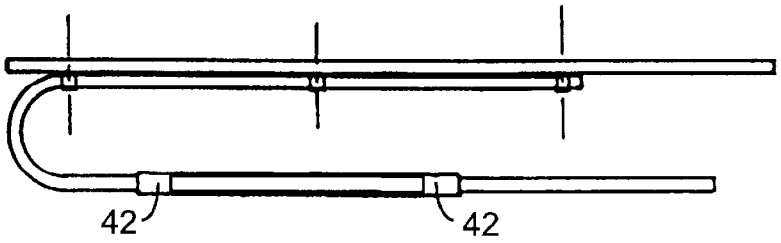
FIG. 32 is a side view of the fully assembled board and support/base of the present invention as shown in FIGS. 30, 31 and 33.
Figure 33:
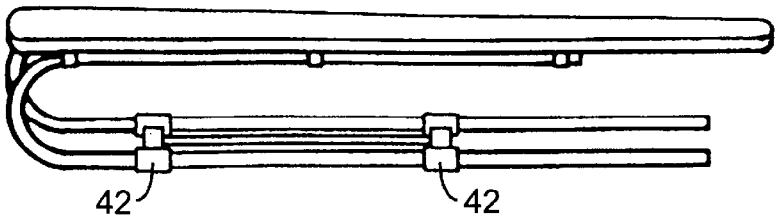
FIG. 33 is a top/side view of the embodiment of FIG. 32.

End or cross members 42 are made of steel or copper metal and the end hooks 44, 45 have an inside diameter slightly larger than the outside diameter of legs 32 of base portions 31. End or cross members 42 are about 22 to 25 centimeters in length and longitudinal handle member 43 is about 60 centimeters long. The substantially circumferential hooks 44 are attached to one of the legs 32 as shown in FIGS. 28 and 29. Then, for complete assembly, the rectilinear member 41 is rotated about leg 32 to which hook members 44 are attached, engaging hooks 45 on the outer surface of the other leg member 32 completing assembly of the structure as shown, for example, in FIG. 30 and FIG. 33. FIGS. 31, 32 and 33 provide additional views of the fully assembled board and support/base structure of FIG. 30, FIGS. 31–33 being views similar to the views illustrated in FIGS. 23–25.

Figure 34:
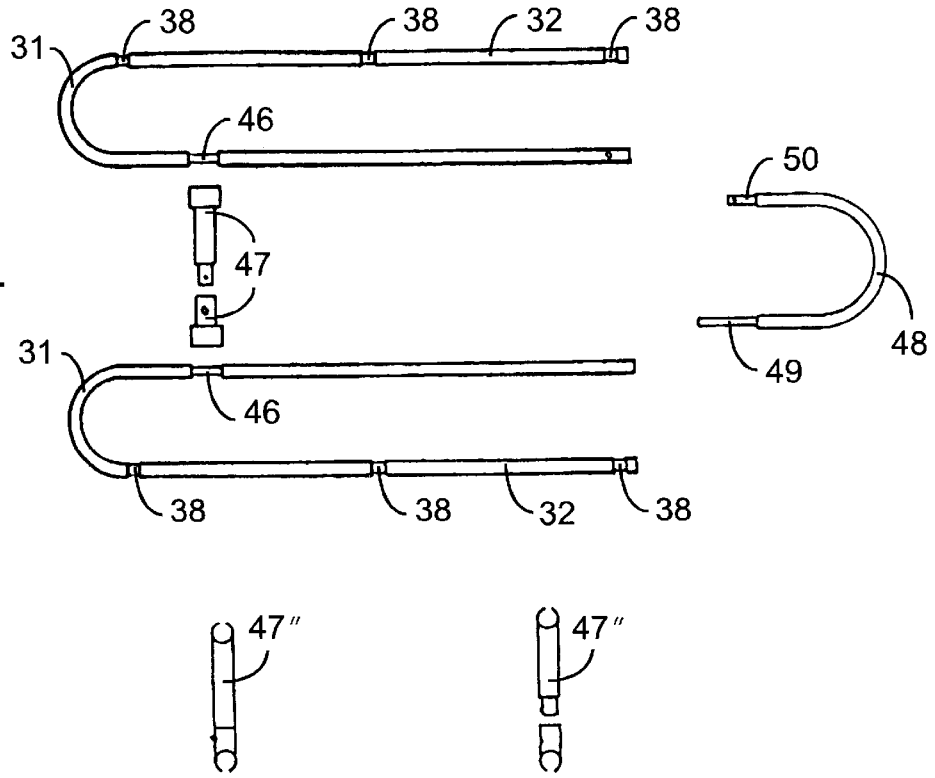
FIG. 34 is a dis-assembled view of the embodiment of FIG. 35.
Figure 35:
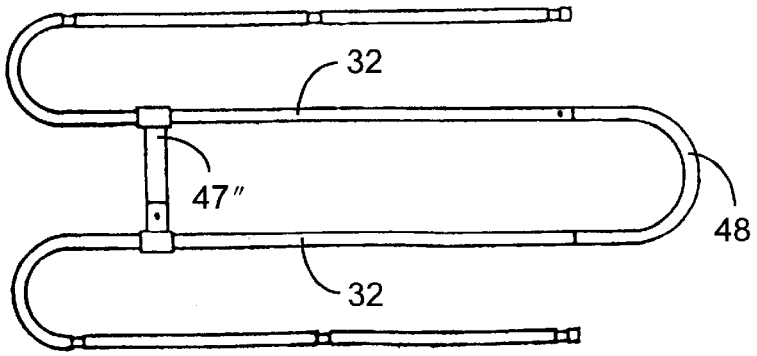
FIG. 35 is a view of an assembled fifth embodiment of the support/base for an ironing board of the present invention.

A fifth embodiment of the support/base for an ironing board of the present invention is illustrated in FIGS. 34 and 35. In this embodiment, the U-shaped base portions 31 are similar to those shown and described in the embodiment of FIGS. 10–12, except that in addition to annular grooves or recesses 38 in the legs 32 to be attached to the bottom surface of the board, the opposite leg 32 also includes a longer circumferential groove or recess 46 which serves as a connecting location for detachable cross brace 47. As further shown in FIG. 34, edge views of cross brace 47 are shown at 47' showing the cross brace in its dis-assembled state as at 47, and further in its assembled state as shown at 47". Each end of cross brace 47 includes a substantially circumferential hook open at the ends of the longitudinal axis of cross brace 47 for grasping leg 32 at circumferential recess 46, as shown in FIG. 35.

This embodiment further comprises a shorter U-shaped element 48 having smaller diameter extensions which fit inside the free ends of tubular legs 32 as shown in FIGS. 34 and 35. As shown in FIG. 34, one of the extended ends of shorter U-shaped element 48 is a longer, lesser diameter portion 49, while the other extension is a shorter lesser diameter portion 50 which, like the corresponding end of tubular leg 32 includes a diametrically bored hole through which a fastener can be affixed for retaining element 48 in the ends of legs 32. The fastener in the hole in the end of extension 50 may constitute a spring-loaded "pip" which can be depressed when inserting extension 50 into the end of tubular leg 32 and the exterior locking portion of the spring-loaded "pip" will then engage in the corresponding hole near the end of tubular legs 32 thus locking short horseshoe 48 in the ends of leg 32. Short horseshoe element 48 has a length of about 20 to 25 centimeters plus the extension fittings. The dimensions of the other elements of this embodiment are similar to the dimensions of the previously described embodiments.

Figure 36:
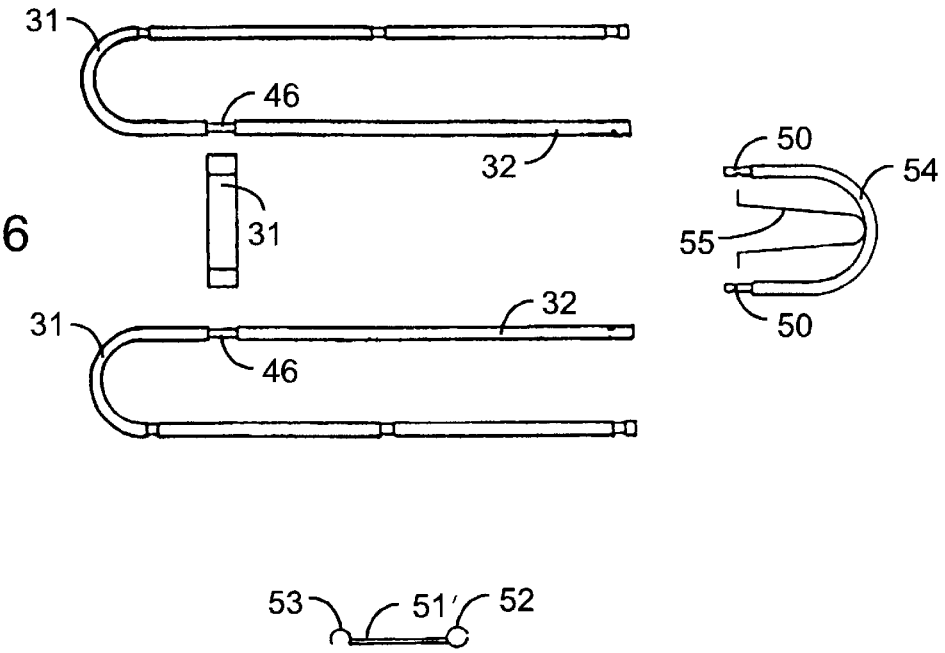
FIG. 36 is a dis-assembled view of the embodiment of FIG. 37.
Figure 37:
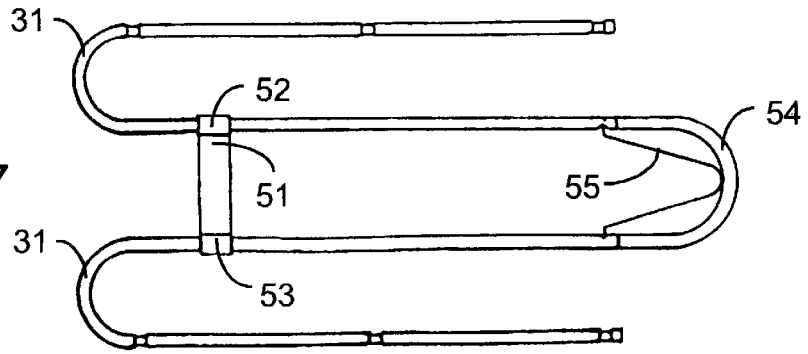
FIG. 37 is a view of an assembled sixth embodiment of the support/base for an ironing board of the present invention.

A sixth embodiment of the support/base structure for an ironing board of the present invention is illustrated in FIGS. 36 and 37 which are views similar to those presented for the embodiment shown in FIGS. 34 and 35, particularly the upper base member 31 as illustrated in FIG. 34. The embodiment of FIGS. 36 and 37 also includes a cross bar or member 51, an edge view of which is shown at 51'. One end of end cross bar 51 has a virtually circumferential hook with an opening at the outer periphery, the other end cross bar 51 has a greater than semi-circumferential hook 53, the inner diameter of hooks 52 and 53 being just greater than the outer diameter of the recessed portions 46 of legs 32 of base members 31.

This embodiment also includes a third, smaller horseshoe or U-shaped member 54. The ends of each of the legs of U-shaped member 54 include extensions 50 which include through holes having axes generally parallel to the plane of the U-shaped member. Similarly oriented holes also appear in the exterior surface of leg 32 of each base member 31 into which extensions 50 of horseshoe 54 extend during assembly. Also attached to the interior of the base of the U-shaped member 54 is a generally V-shaped spring-like device lying generally in the plane of U-shaped member 54, and having distal ends of its legs extending generally perpendicular to extensions 50 and located substantially coaxially with the holes in extensions 50. When the horseshoe-shaped member 54 is assembled with base members 31 by inserting extensions 50 into the respective ends of legs 32 of each of the base members 31, horseshoe member 54 is finally locked in engagement with the base members 31 by insertion of the distal ends of spring-like member 55 through the holes near the ends of legs 32 and into the coaxial holes in extensions 50, as shown in FIG. 37.

In FIG. 37 cross bar 51 is also shown with its hooks 52, 53 engaged over recessed portions 46 of legs 32 of base members 31. Horseshoe or U-shaped member 54 is similar in size to corresponding member 34 illustrated in FIG. 3. However, the extensions 50 as illustrated in FIG. 36 extend about 5 centimeters in length and are of reduced diameter sufficient to fit within the interior diameter of legs 32. The spring-like double hook member 55 may be welded to U-shaped member 54 where the base of V-shaped member 55 contacts the interior of the U surface of U-shaped member 54.

Figure 38:
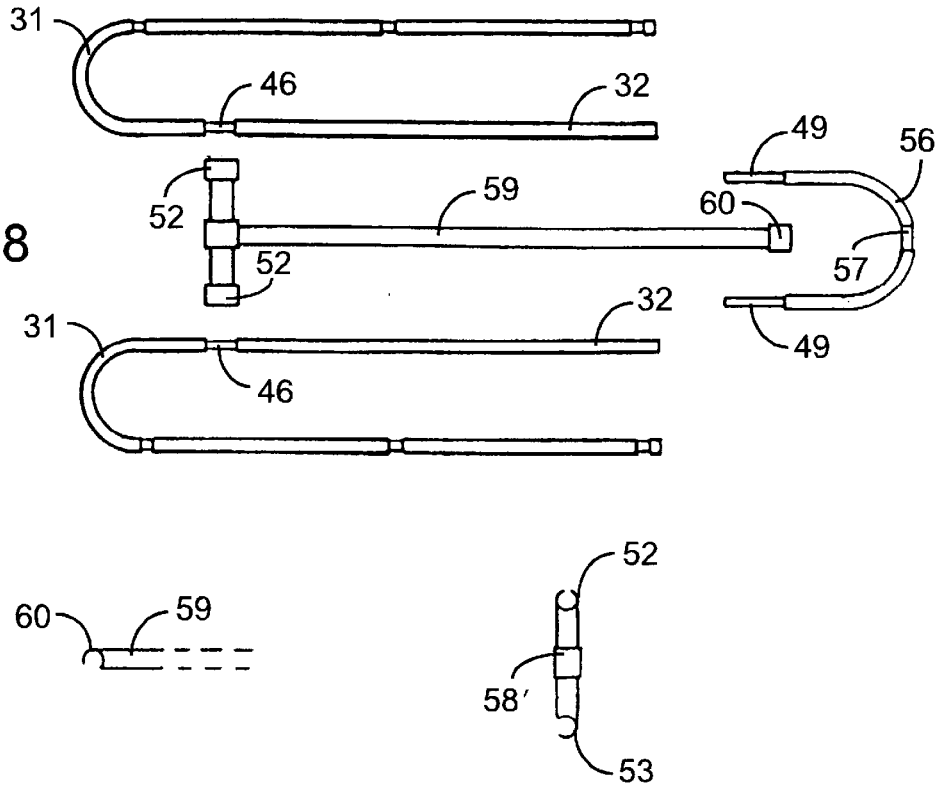
FIG. 38 is a dis-assembled view of the embodiment of FIG. 39.
Figure 39:
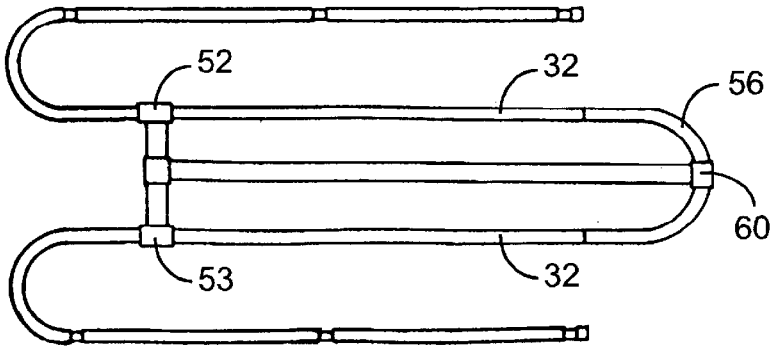
FIG. 39 is a view of an assembled seventh embodiment of the support/base for an ironing board of the present invention.

A seventh embodiment of the support/base structure for an ironing board of the present invention is illustrated in FIGS. 38 and 39. In this embodiment, the base portions 31 are substantially identical to the lower base member 31 illustrated in FIG. 36, with the exception that there is no hole in the exterior surface near the free end of interior leg 32. This embodiment also includes a third U-shaped member 56 which is similar to size and shape to element 48 illustrated and described in conjunction with FIG. 34, except that this horseshoe 56 includes two lesser diameter extensions 49 each having a length of approximately 10 centimeters and diameter just less than the inside diameter of legs 32 of base members 31. U-shaped member 56 also includes an annular groove or recess 57 in the central base portion of the U portion thereof.

When this embodiment of the support/base structure is assembled as shown in FIG. 39, extensions 49 of the horseshoe 56 are slipped into the open ends of legs 32. The three U-shaped members 31, 31 and 56 are then held together by a T-shaped brace structure comprising a cross bar portion 58 and a longitudinally extending portion 59. An edge view of cross bar 58 is shown at 58' illustrating partially circumferential hook portions 52 and 53 quite similar to the corresponding elements of the embodiment illustrated in FIG. 36. An edge view at 59' of the end of longitudinal bar 59 illustrates hook portion 60. When assembly is completed as shown in FIG. 39, hooks 52 and 53 are engaged over recessed portions 46 of legs 32, and hook 60 is engaged over recessed portion 57 of horseshoe 56. In this way, the T-shaped structure 58, 59 holds the three U-shaped members 31, 31 and 56 together in a stable support/base structure. Cross bar 58 has a length of about 20 centimeters, and longitudinal bar 59 has a length of about 90 centimeters.

An eighth embodiment of the support/base structure for an ironing board of the present invention is illustrated in FIGS. 40, 40A, 40B and 41. In this embodiment, base members 31 correspond in shape and size to those illustrated and described in conjunction with FIG. 19. Base members 31 are connected by a rectilinear structure 60 somewhat similar to structure 40 in FIG. 19, but capable of being disassembled into two distinct portions.

Figure 40:
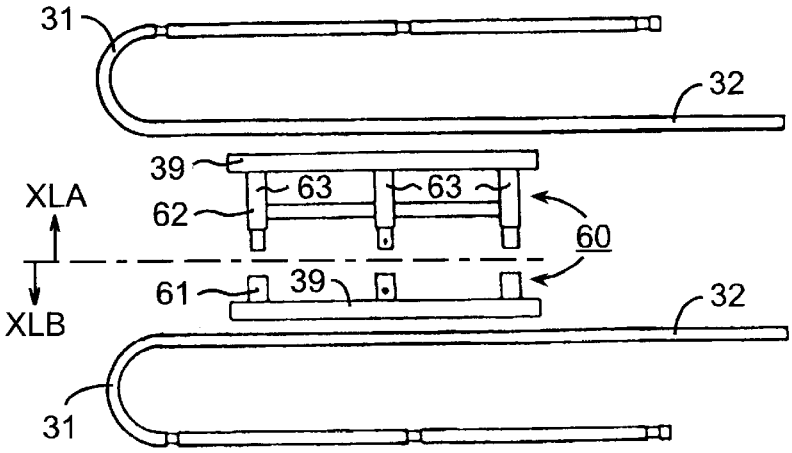
FIG. 40 is a dis-assembled view of the embodiment of FIG. 41.
Figure 40:
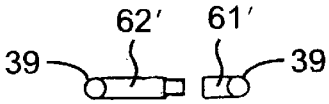
Figure 40A:
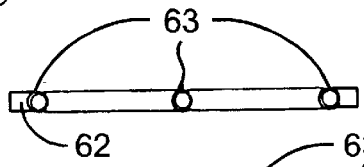
FIGS. 40A and 40B show the complementary structures 62 and 61, respectively, viewed from lines XL in FIG. 40.
Figure 40B:
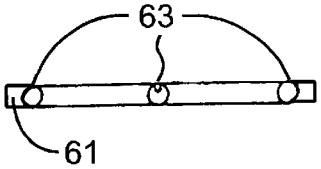
Figure 41:
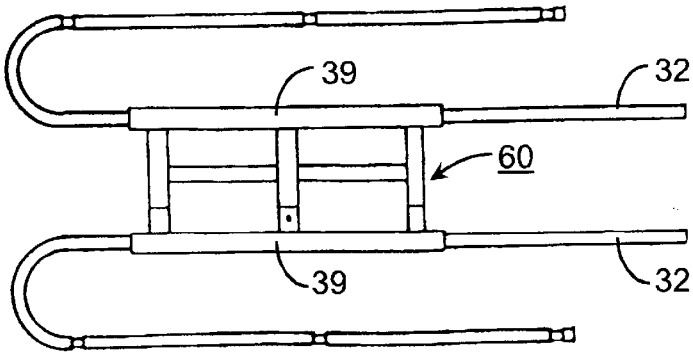
FIG. 41 is a view of an assembled eighth embodiment of the support/base for an ironing board of the present invention.

Rectilinear structure 60 comprises tubular rails 39 whose inside diameter is just larger than the outside diameter of leg 32 of base members 31 so that hollow rails 39 can slip fit over legs 32 as shown in FIG. 41. The assembly feature of structure 60 is illustrated in FIG. 40 wherein portions 61 and 62 are shown in partially-exploded schematic relationship. An end view of these elements is shown with portions 61' and 62' being in a partially-exploded relationship between tubular rails 39. The inter-fitting relationship of the three illustrated cross bar portions 63 is illustrated by FIGS. 40A and 40B, respectively, which correspond to views from line XLA in the central portion of FIG. 40. The ends of upper cross bars 63 as shown in FIG. 40 slip into the mating ends shown in the lower portion of structure 60 in FIG. 40, and a pin and hole arrangement in central cross bar 63 provide locking engagement for maintaining the structure 60 in assembled condition as shown in FIG. 41.

Figure 42:
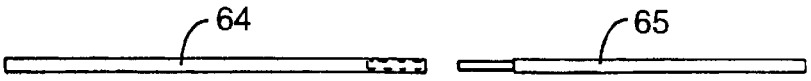
FIG. 42 is an edge, exploded view of a two-piece solid board according to the present invention.
Figure 43:
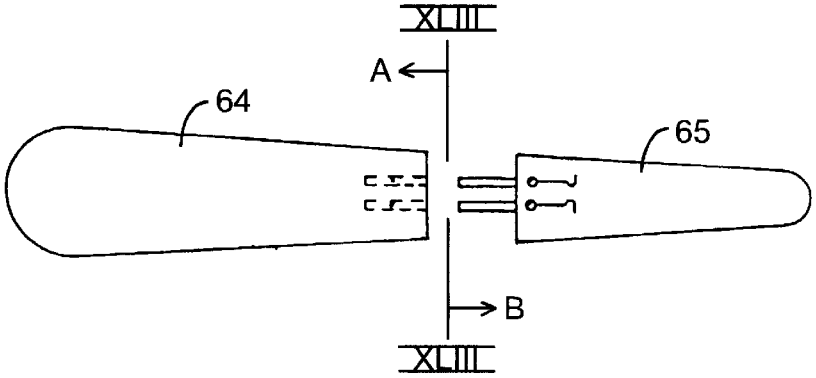
FIG. 43 is a top, exploded view of the board of FIG. 42.
Figure 43B:
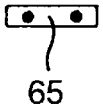
FIGS. 43A and 43B are end views of the respective portions of the board of FIG. 43 taken in the directions shown on line XLIII in FIG. 43.
Figure 43A:
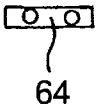
Figure 44:
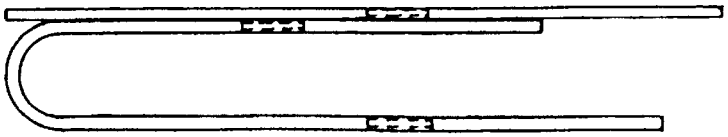
FIG. 44 is a side view of the assembled board of FIGS. 42 and 43 also including support/base structure.

A further embodiment of the ironing board of the present invention is illustrated in FIGS. 42–44. FIG. 42 shows an edge view, and FIG. 43 shows a top view of an inventive ironing board which may be dis-assembled into two pieces 64, 65. The mating ends of pieces 64, 65 are illustrated in FIGS. 43A and 43B, respectively, which are views from line XLIII in FIG. 43. The assembled structure, including a support/base structure which likewise may be dis-assembled into shorter lengths, is illustrated in FIG. 44.

Figure 45:
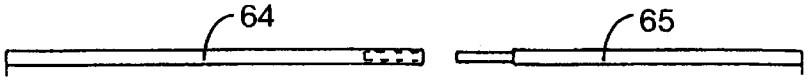
FIGS. 45, 46, 46A, 46B and 47 illustrate a mesh ironing board otherwise similar to that illustrated in FIGS. 42, 43, 43A, 43B and 44.
Figure 46:
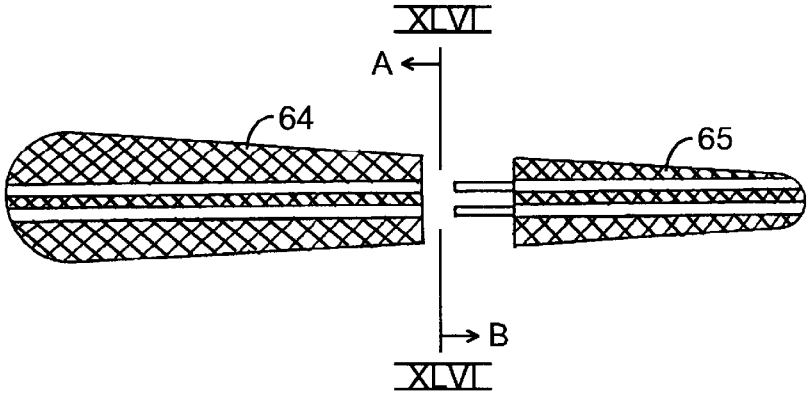
Figure 46B:
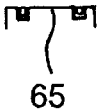
Figure 46A:
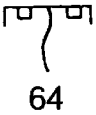
Figure 47:
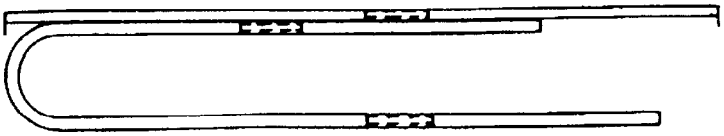

FIGS. 45–47 illustrate a further embodiment similar to that illustrated in FIGS. 42–44, but wherein the board portion of the device is a mesh board suitable for use with steam irons. The views of FIGS. 45, 46, 46A, 46B and 47 otherwise correspond to the views of FIGS. 42–44.

Figure 48:
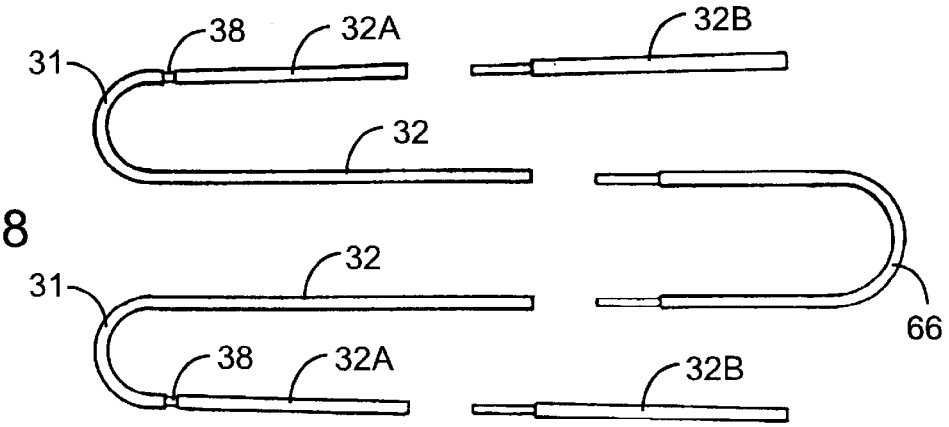
FIG. 48 shows an exploded view of support/base structure useful for the boards illustrated in FIGS. 42–47.

FIGS. 48–51 show four embodiments of support/base structures suitable for use with the board embodiments of FIGS. 42–44 and 45–47, respectively. The embodiment illustrated in FIG. 48 may be considered similar to the embodiment first presented in FIG. 3, except that the U-shaped base portions 31 are shorter than the corresponding portions in the embodiment of FIG. 3. Indeed, even the longest legs 32 of the embodiment of FIG. 48 are sufficiently short that the length of the support/base structure as assembled can be reduced almost by half by dis-assembling the structure illustrated in FIG. 48. This is accomplished by making the length of the outer legs 32 dis-assemblable into portions 32A and 32B, respectively, and lengthening the legs of the third U-shaped member 66 as shown in FIG. 48. Thus reduced diameter extensions of the legs of U-shaped member 66 and outer ends of legs 32B are assembled by insertion into the open ends of tubular legs 32 and 32A of tubular base members 31, as described previously herein.

Figure 49:
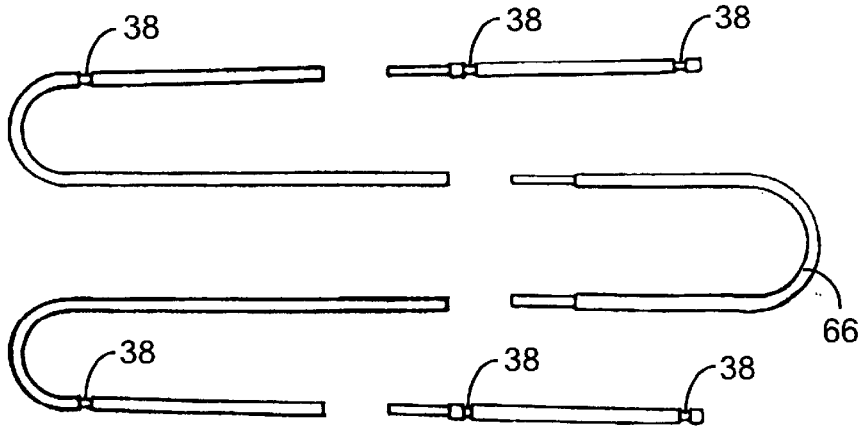
FIG. 49 illustrates an exploded view of another support/base structure useful like the structure illustrated in FIG. 48.

The embodiment of FIG. 49 is quite similar to the embodiment of FIG. 48 except that the embodiment of FIG. 49 includes a plurality of circumferential grooves or recesses 38 on each of the outer legs 32 whereas there is only a single recess 38 on each of the outer legs in the embodiment of FIG. 48.

Figure 50:
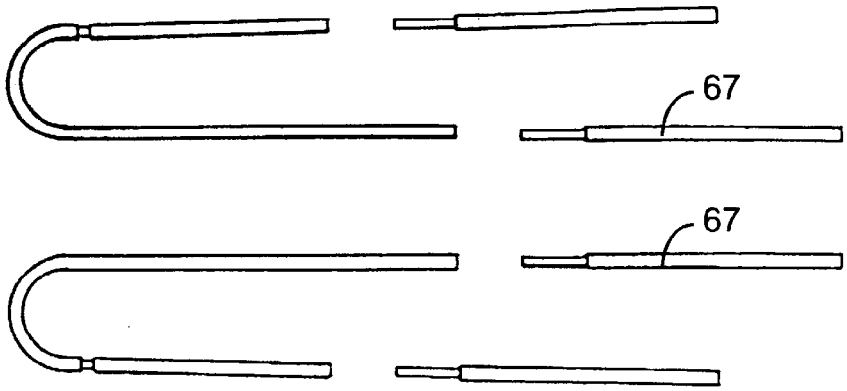
FIG. 50 illustrates an exploded view of still another support/base structure useful like the structure illustrated in FIG. 48.
Figure 51:
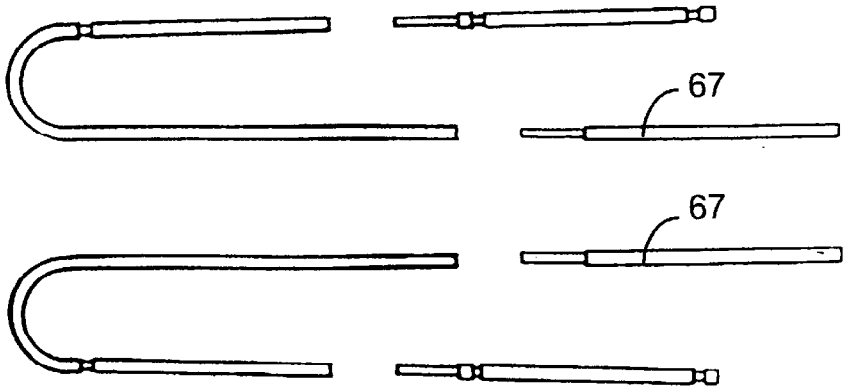
FIG. 51 illustrates an exploded view of still another support/base structure useful like the structure illustrated in FIG. 48.

The further embodiment of FIG. 50 is very similar to the embodiment of FIG. 48 except that leg extension portions 67 are straight, rather than being connected by a U-shaped bend as in element 66 in the embodiment of FIG. 48. The further embodiment of FIG. 51 relates to the embodiment of FIG. 49 in the same way that the embodiment of FIG. 50 relates to the embodiment of FIG. 48. In any of the embodiments of FIGS. 48–51, the extensions which fit inside the tubular leg portions may simply push or slide directly in, or may be fitted with threads to screw into engagement with each other. The embodiments of FIGS. 50 and 51, when assembled, look similar to those illustrated in FIGS. 18 and 19.

Figure 52:
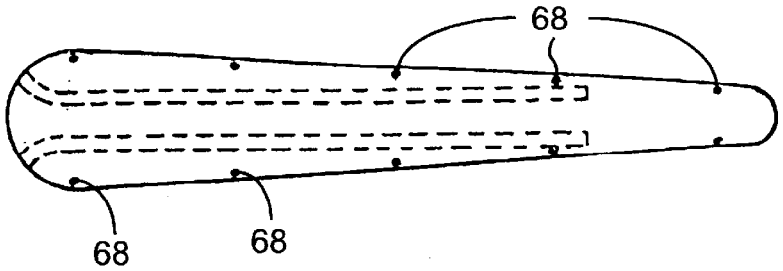
FIG. 52 shows a bottom view of an ironing board of the present invention illustrating the location of attachment fixtures for use with a ironing board cover.
Figure 53:
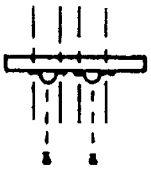
FIG. 53 shows an end view of a board like that shown in FIG. 52, illustrating the location of fixtures on the bottom of the board for attachment of support/base structure.
Figure 54:
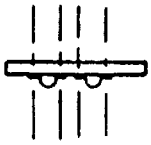
FIG. 54 is another view similar to that shown in FIG. 53.
Figure 55:
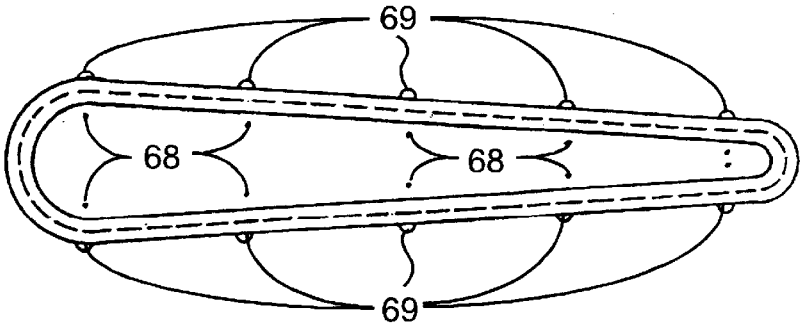
FIG. 55 is a bottom view of a board like that shown in FIG. 52 overlying the bottom view of a flexible ironing board cover.
Figure 56:
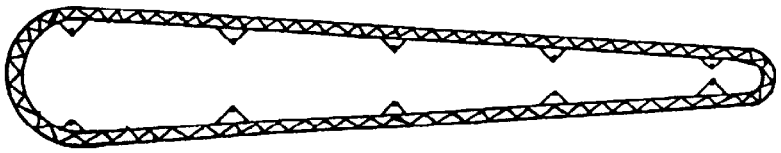
FIG. 56 is a bottom view similar to that shown in FIG. 55, but with peripheral loops on the ironing board cover hooked on the fixtures on the bottom surface of the board.

Further features of the ironing board of the present invention are illustrated in the embodiment shown in FIGS. 52–56. In FIG. 52, the bottom surface of an ironing board is shown with cover-retaining pins or hooks 68 shown at locations spaced around the periphery of the bottom of the board. FIGS. 53 and 54 are end views of a board like that illustrated in FIG. 52 showing only the location of fastening means for retaining legs 32 of base members of support/base structures assembled in conjunction with such a board. FIG. 55 shows a board like that illustrated in FIG. 52 lying bottom side up on a flexible ironing board cover. Again, pins or hooks 68 are shown around the periphery of the board, and corresponding loops 69 are shown around the periphery of the cover. FIG. 56 shows the cover having been installed on the board by looping loops 69 over pins or hooks 68 thereby securing the cover on the ironing board.

Figure 58:
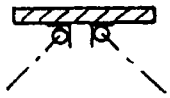
FIGS. 58 and 59 show end views of a board like that illustrated in FIG. 57, additionally showing two embodiments of fixtures for fastening support/base structure to the mesh board.
Figure 59:
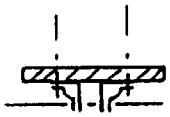
Figure 60:
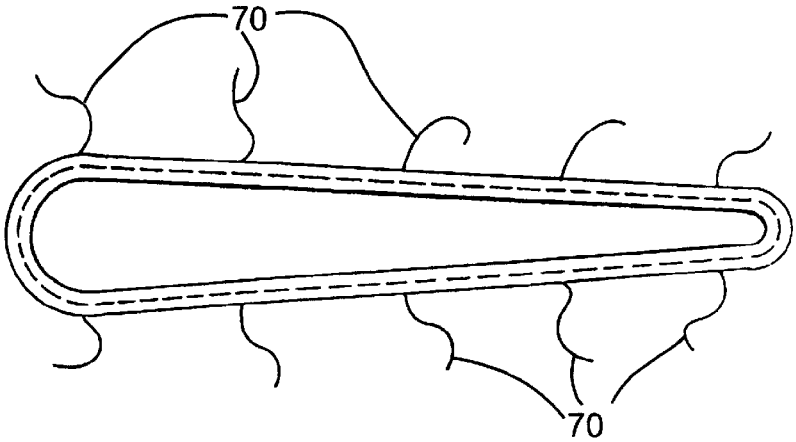
FIG. 60 shows a bottom view of an ironing board of the present invention overlying another form of ironing board cover.
Figure 61:
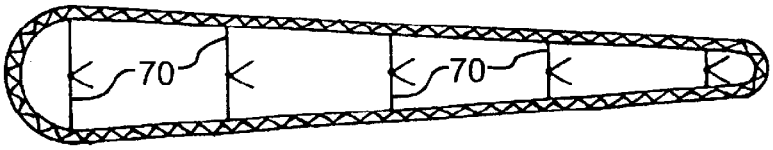
FIG. 61 shows a bottom view of an ironing board with cover similar to that shown in FIG. 60, but with the tie fasteners of the cover tied behind the bottom surface of the board.
Figure 62:
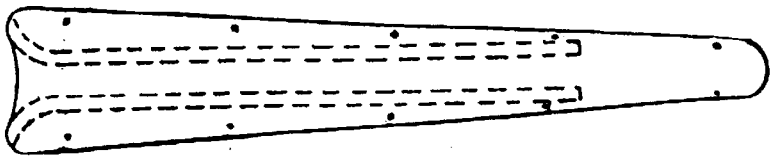
FIG. 62 shows a bottom view of another form of ironing board in accordance with the present invention.
Figure 63:
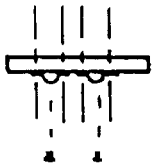
FIGS. 63, 64, 65 and 66 are views of the board of FIGS. 62 corresponding to the views of FIGS. 53–56.
Figure 64:
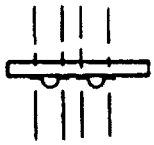
Figure 65:
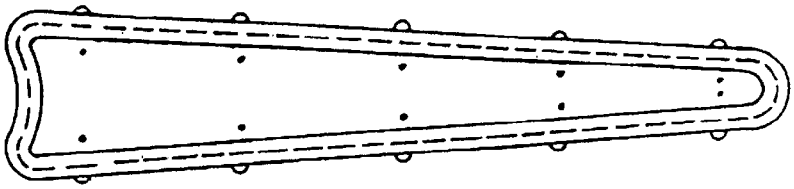
Figure 66:
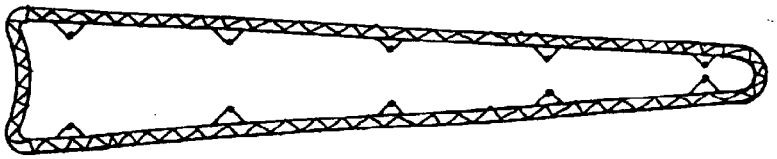
Figure 67:
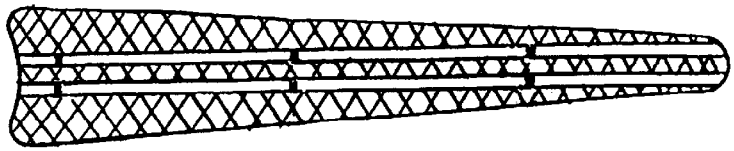
FIG. 67 shows another form of mesh ironing board in accordance with the present invention similar to the board shown in FIG. 62.
Figure 68:
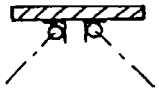
FIGS. 68. 69, 70 and 71 are views of the board of FIGS. 67 corresponding to the views of FIGS. 58–61.
Figure 69:
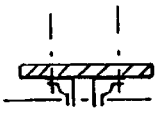
Figure 70:
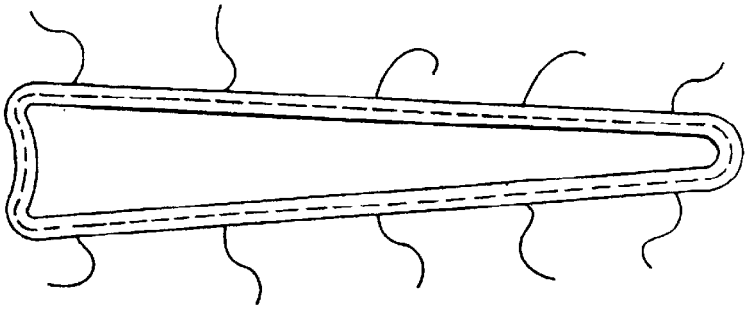
Figure 71:
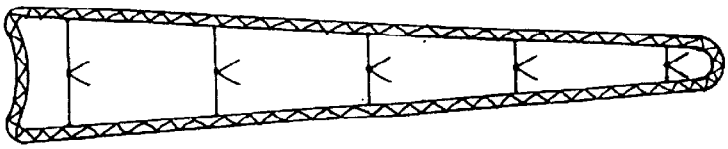
Figure 72:
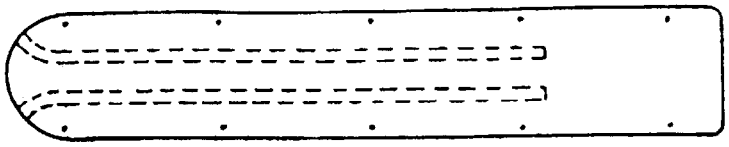
FIG. 72 shows a bottom view of another form of ironing board in accordance with the present invention.
Figure 73:
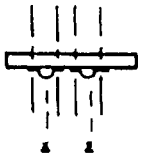
FIGS. 73, 74, 75 and 76 are views of the board of FIG. 72 corresponding to the views of FIGS. 53–56.
Figure 74:
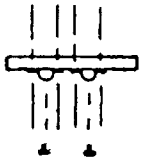
Figure 75:
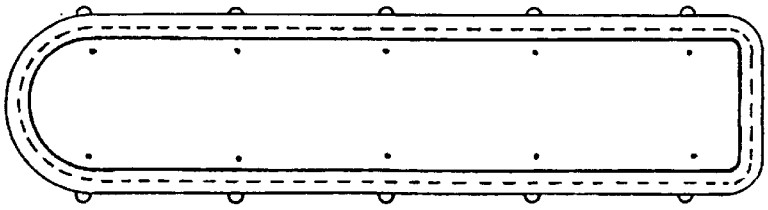
Figure 76:
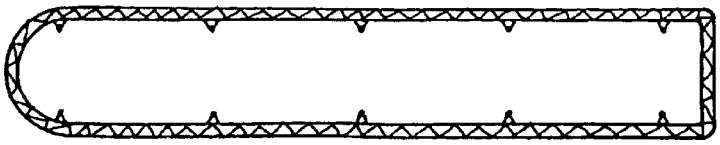
Figure 77:
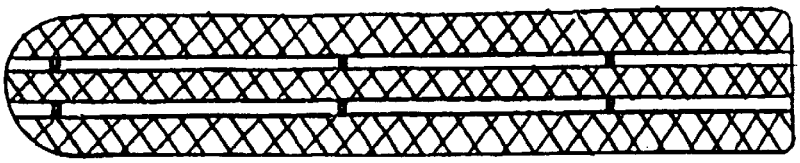
FIG. 77 shows a bottom view of another form of mesh ironing board in accordance with the present invention similar to the board shown in FIG. 57.
Figure 78:
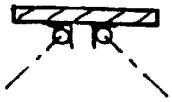
FIGS. 78, 79, 80 and 81 are views of the board of FIG. 77 corresponding to the views of FIGS. 58–61.
Figure 79:
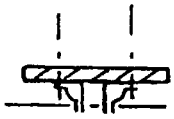
Figure 80:
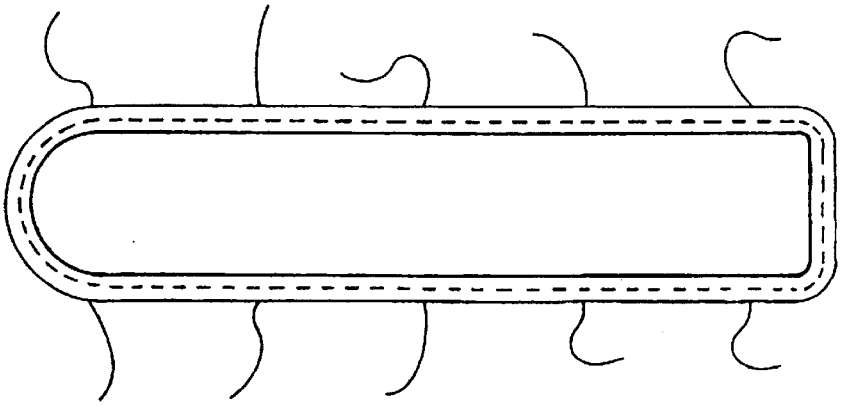
Figure 81:
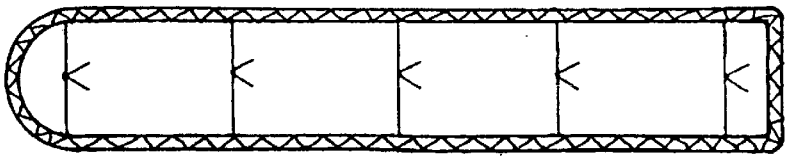
Figure 82:
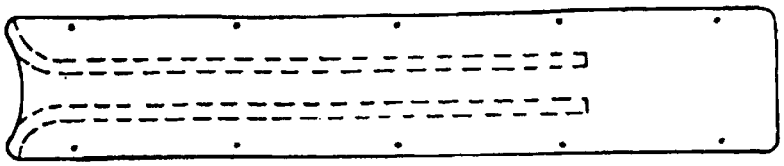
FIG. 82 shows a bottom view of another form of ironing board in accordance with the present invention.
Figure 83:
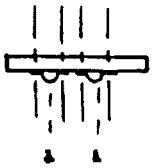
FIGS. 83, 84, 85 and 86 are views of the board of FIG. 82 corresponding to the views of FIGS. 53–56.
Figure 84:
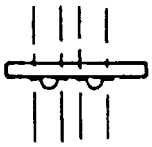
Figure 85:
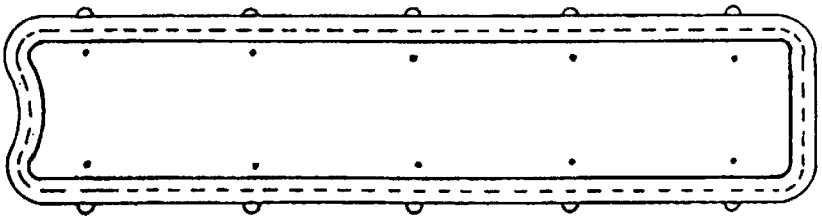
Figure 86:
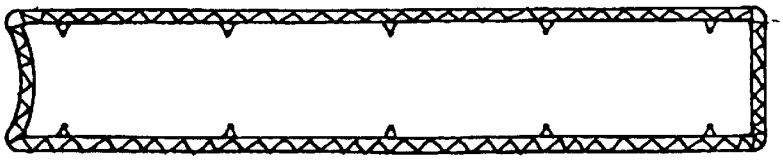
Figure 87:
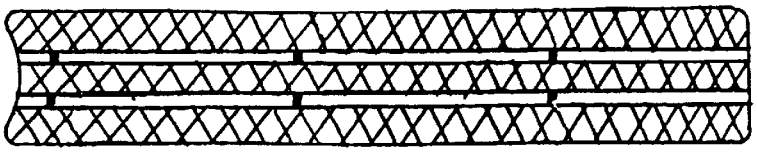
FIG. 87 is a bottom view of another form of mesh ironing board according to the present invention showing the location of support/base structure and fixtures therefor as in FIG. 57.
Figure 88:
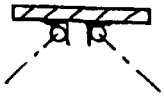
FIGS. 88, 89, 90 and 91 are views of the board like those illustrated in FIGS. 58–61.
Figure 89:
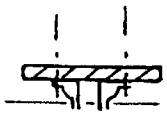
Figure 90:
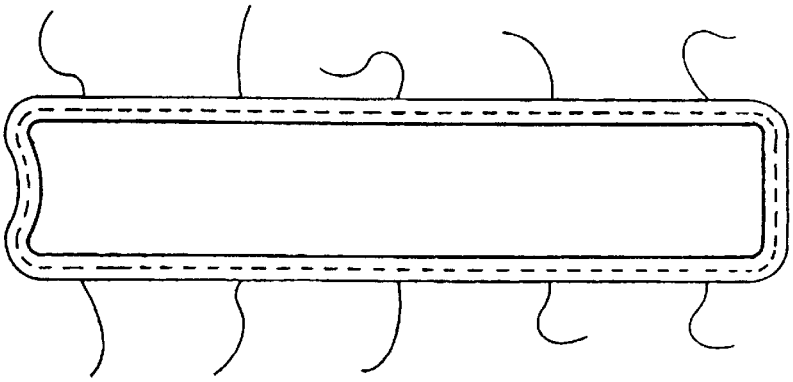
Figure 91:
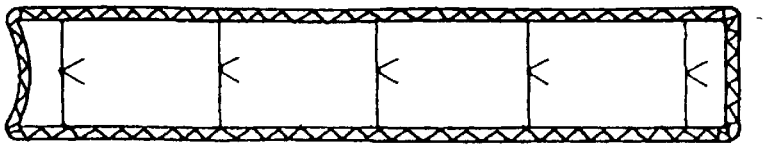

A further embodiment of the ironing board of the present invention is illustrated in FIGS. 57–61, which generally correspond to the views of the embodiment illustrated in FIGS. 52–56, respectively. However, the board illustrated in FIG. 57 has a mesh surface as mentioned previously in conjunction with embodiment of FIGS. 45 and 46. The surface of the board itself is cut from metallic mesh and is about 120 centimeters long, tapering from a width of about 22 centimeters near the left end to a width of about 9 centimeters near the right end. A metal strip about 2.5 centimeters tall is attached, for example, by welding, around the edge of the metal mesh surface. Two reinforcing bars of angle iron, as shown in FIGS. 58 and 59, are attached, by welding, to the underside of the mesh to reinforce it throughout its length. Rings or saddle clips are attached to the reinforcing bar, for example by welding, to attach the mesh board to a suitable support/base structure as described herein. FIG. 60 illustrates a board such as that shown in FIG. 57 lying bottom side up on a flexible ironing board cover, which cover includes ties 70 extending from locations spaced around the periphery of the flexible cover. FIG. 61 shows pairs of ties tied together across the bottom side of the board thus securing the cover onto the board.

Further embodiments of board shapes and attached covers are shown in FIGS. 62–66, 72–76 and 82–86 which correspond, respectively, to the views illustrated in FIGS. 52–56. And, further embodiments of the shapes of mesh boards of the present invention, with covers, are illustrated in FIGS. 67–71, 77–81, and 87–91, respectively, which views correspond to the views illustrative of the embodiments shown in FIGS. 57–61.

Still further features of the ironing boards of the present invention are illustrated in FIGS. 92–97 and 98–105, respectively. FIGS. 92, 94, 95 and 96 illustrate a smaller ironing board of the present invention having a pivot fixture whereby the board may swing in a plane generally corresponding to the plane of the board itself about an axis perpendicular to that plane and located near the wider end of the smaller board. This pivot fixture 80 is shown as concentric circles in FIG. 92 and as a single circle in FIGS. 94 and 94A.

Figures 92, 93A, 93B, 94, 94B, 95, 96, 97A, 97B:
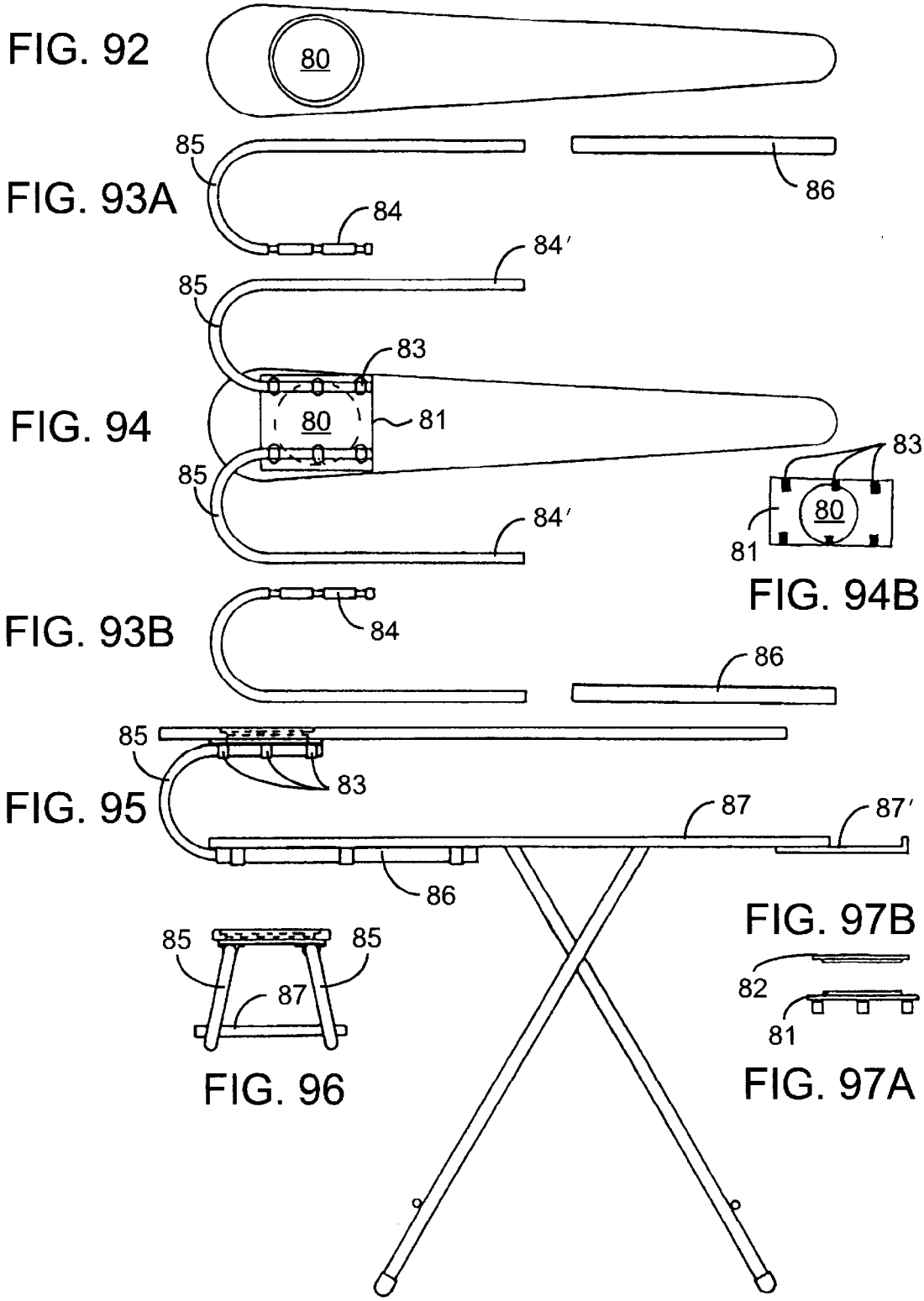
FIG. 92 shows a top view of an ironing board of the present invention including a pivot unit permitting angular movement of the board in a plane corresponding to the plane of the board and about an axis perpendicular to the plane of the board.
FIG. 93A and FIG. 93B each show, in exploded view, a dis-assembled partially U-shaped leg for a support/base for the board of FIG. 92 and FIGS. 94–97.
FIG. 94 shows a bottom view of the board of FIG. 92 having U-shaped portions of support legs connected to a base portion of a pivot unit mounted on the bottom surface of the board.
FIG. 94B shows a bottom view of the bottom portion of the pivot unit.
FIG. 95 shows a side view of the pivotal board of FIG. 92 mounted on a larger ironing board or table.
FIG. 96 is an end view from the left end of the board portions of FIG. 95.
FIG. 97A is a side edge view of the bottom portion of the pivot unit also illustrated in FIG. 94A.
FIG. 97B is a side edge view from a similar point of view as FIG. 97A, but of the top portion of the pivot unit which fits together with the bottom portion shown in FIG. 97A in the manner shown in broken lines in FIGS. 95 and 96.

A base portion 81 shown in FIGS. 94A and 97A has a rectangular base upon which a lower portion of the circular pivot device is mounted. The rectangular base is attached to the bottom surface of the smaller ironing board with the circular portion extending upwardly through a circular hole in the smaller board. Once the lower portion 81 is secured to the bottom of the board, upper portion 82 illustrated in FIG. 97B can be installed from the top of the board and connected, for example, by screw threading with lower portion 81, thus holding the board yet permitting the board to pivot about an axis perpendicular to the board at about the center of circles 80.

The connected upper and lower portions 82, 81 of the pivot device are shown in broken lines in the side and end views of FIGS. 95 and 96, respectively.

Lower portion 81 also has fasteners 83 thereon, such as saddle fasteners or the like, for securing legs 84 of U-shaped support members 85 to the bottom of the small board, as illustrated in FIGS. 94 and 95. The support system also comprises straight tubular member 86 which may be secured to the lower surface of a larger ironing board or ironing table 87 as illustrated in FIG. 95, so that arms 84' of support members 85, as shown in FIG. 94, can be inserted within tubular members 86 as shown in FIGS. 95 and 96 thus supported the smaller board of the present invention over larger ironing table or board 87. This arrangement permits use of the smaller board of the present invention directly over a larger ironing board or table 87 whenever desired, yet the larger surface of board or table 87 may be used without interference by the smaller board by simply rotating the smaller board about the axis of the pivot device 80 thereby moving the smaller board away from the top surface of larger board or table 87.

Figures 98, 99, 99A, 99B, 100A, 100B, 100C, 101, 102, 103, 104, 105:
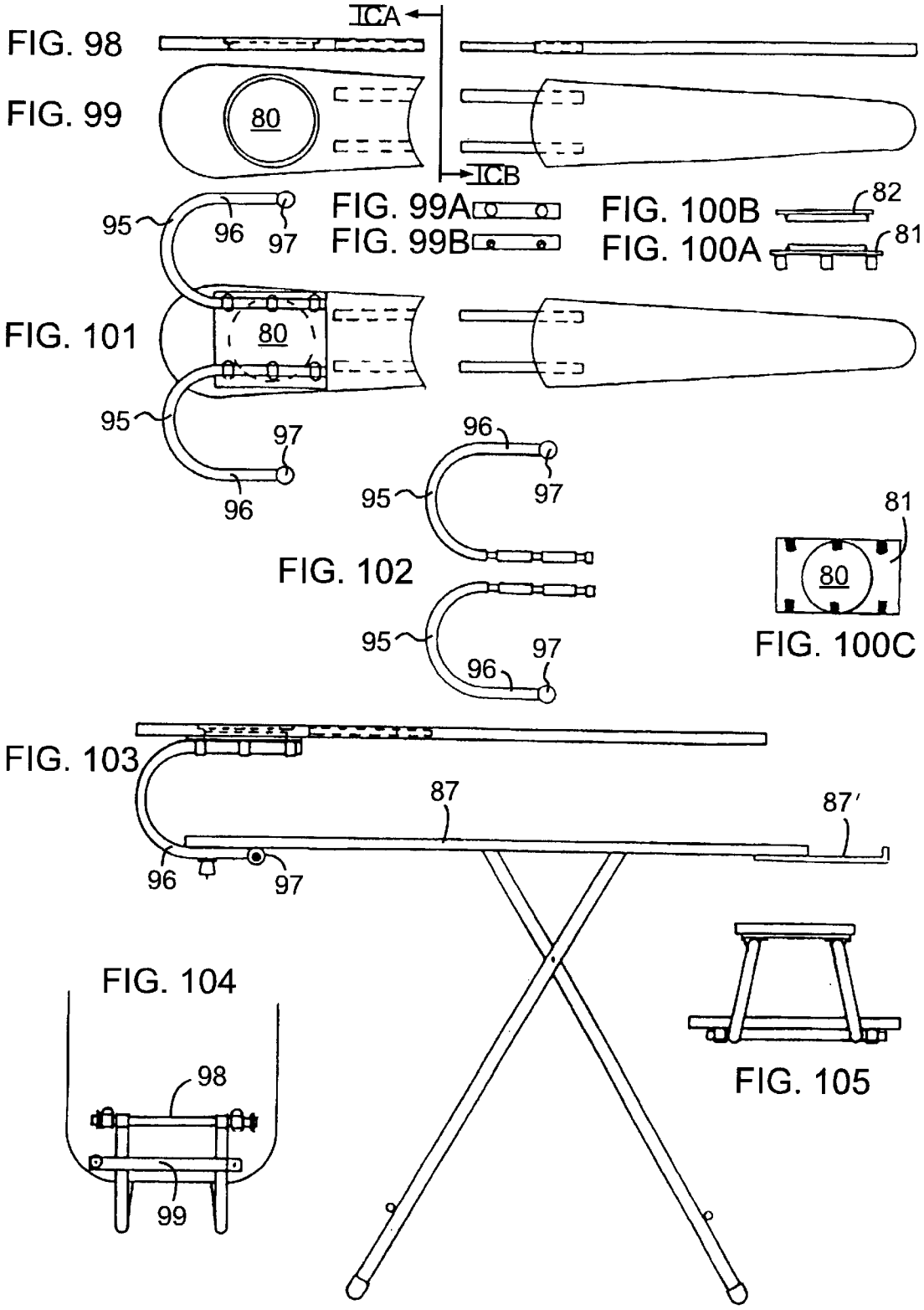
FIGS. 98 and 99 show edge and top exploded views of a two-piece board otherwise similar to that shown in FIG. 92.
FIGS. 99A and 99B show end views of each portion of the board of FIG. 99 taken along lines ICA and ICB, respectively.
FIG. 100A shows a side view of a pivot unit like that shown in FIG. 97A.
FIG. 100B shows a side view of a top portion of a pivot unit like that shown in FIG. 97B.
FIG. 100C shows a bottom view of a pivot unit like that shown in FIG. 94A.
FIG. 101 shows a bottom view of the board of FIGS. 98 and 99 having the bottom portion of the pivot unit installed therein including partially U-shaped leg portions attached to the bottom of the pivot unit.
FIG. 102 shows two partially U-shaped leg portions for use in conjunction with the base of a pivot unit.
FIG. 103 shows a side view of the assembled board of FIGS. 98–102 attached to a larger ironing board or table.
FIG. 104 is a bottom view of the left end portion of the larger ironing board or table of FIG. 103, showing the attachment system by which a smaller board is attached to the larger board.
FIG. 105 is an end view of the board portions of FIG. 103.

Still a further embodiment of the ironing board structure of the present invention is illustrated in FIGS. 98–105, respectively. The small board with pivoting device as illustrated in FIGS. 98–102 is similar in detail to the embodiment illustrated in FIGS. 92–97B except that the embodiment of FIGS. 98–102 may be dis-assembled like the board embodiment illustrated in FIGS. 42–43B, supra. Additionally, the supporting members 95 each have legs 84 which are quite similar to legs 84 in the embodiment of FIGS. 92–94, however, the opposite legs 96 terminate in circumferential sleeves 97 which are fixed on a rod 98 connected to the lower surface of larger ironing board or table 87 as shown in FIGS. 103–105. This structure is complemented by bar 99 which is pivotally secured at one end to the underside of larger ironing board or table 87 and releasably secured at its other end by a tightening knob or the like for locking support members 95 in relationship to the bottom surface of larger board or table 87, as shown in FIGS. 103, 104 and 105.

The embodiment of FIGS. 98–105 provides additional flexibility in that not only can it be dis-assembled and stored in a smaller space, but the detachable right-hand portion of the smaller board can be extended, at least somewhat, during use, for example when ironing on entire sleeve or children's trousers or the like. To facilitate such use, any cover placed on the two-piece, extendable ironing board, likewise needs to be in corresponding separate pieces. FIGS. 95 and 103 also illustrate that larger ironing board or table 87 may include an iron rest 87' on which an iron being used may be placed while the smaller board of the present invention may be swiveled into and out of position for use over the upper surface of the larger ironing board or table 87. And, this adjustment of the smaller board into and out of useful position over the upper surface of larger board 87 can be accomplished without interfering with a hot iron located in iron rest 87'. Similarly, the iron may be placed and removed from iron rest 87' without collision with the smaller board of the present invention.

Other advantages and obvious variants of the advantageous ironing board structure of the present invention may occur to those conversant with this art and are intended to be included within the scope and spirit of the invention as claimed in the following claims.

I claim:

1. Board for ironing garments in their entirety including their least accessible areas, comprising a long narrow board over which the garments can be slipped and connected to which there are two support legs each in the shape of a horizontal U articualted to the bottom of the board at their horizontal upper arms so that they can be folded out flat on either side of the board, and means for connecting the lower horizontal arms of the two legs together so that they are further apart than the spacing between the two upper arms, to ensure that the two legs remain stable in their generally erect position, wherein the connecting means consists of two tubes slipped over the lower arms, and joined together by at least one spacer piece to keep the assembly blocked and stable.

2. Board according to claim 1, characterized in that the connecting means are secured to the lower part of a larger ironing board and the lower arms of the support legs are slipped into the connecting means.

3. Board according to claim 2, characterized in that the legs are of unequal height and length to allow the ironing board to be placed in a horizontally offset position with respect to the surface of the board to which it is attached.

4. Board according to claim 3, characterized in that the connecting means are held in position with respect to a lower arm of the support legs by snap-fastening means.

5. Board according to claim 2, characterized in that the connecting means are pivoting means fixed under the larger ironing board in such a way that the smaller board can be folded under the ironing board.

6. Board according to claim 1, characterized in that the articulations between the upper arms of the support legs and the board consist of grooves in the arms held in saddle clips fixed under the board and thus holding the arms axially in place.

7. Board according to claim 6, characterized in that the lower arms are longer than the upper arms in order to increase the board stability.

8. Board according to claim 1, in which the board is made of metal mesh and the upper horizontal arms of the support legs are held by brackets welded to the underside of the board, and to which connecting means for accommodating the upper arms are fixed.

9. Board according to claim 8 wherein the board is fitted with a fabric cover covering at least the upper surface of the board.

10. Board according to claim 1, wherein the board and its legs are made as separate parts, in the longitudinal direction and provided with means for connecting them together.

11. Board according to claim 1, characterized in that the board is mounted so that it can pivot about a vertical axis on the horizontal upper arms to free up the working area of a larger ironing board to which the smaller board is attached.

12. Board for ironing garments in their entirety including their least accessible areas, comprising a long narrow board over which the garments can be slipped and connected to which there are two support legs each in the shape of a horizontal U articulated to the bottom of the board at their horizontal upper arms so that they can be folded out flat on either side of the board, and means for connecting the lower horizontal arms of the two legs together so that they are further apart than the spacing between the two upper arms, to ensure that the two legs remain stable in their generally erect position, wherein the connecting means consists of at least one spacer piece extending transversely to one of the arms, articulated to the said one arm at one of its ends and provided with a means of locking onto the other arm at its other end.

13. Board according to claim 12, characterized in that it comprises at least two spacer pieces extending transversely and joined together by another element.

14. Board according to claim 12, characterized in that it comprises a spacer piece located close to the bottom of the horizontal U shape, to hold apart the opposite ends of the lower horizontal arms.

15. Board according to claim 12, characterized in that the lower arms are longer than the upper arms in order to increase board stability.

16. Board according to claim 12, in which the board is made of metal mesh and the upper horizontal arms of the support legs are held by brackets connected to the underside of the board, and to which connecting means for accommodating the upper arms are affixed.

17. Board according to claim 12 wherein, the board and its legs are made as separate parts, in the longitudinal direction and provided with means for connecting them together.

* * * * *